US010662393B2

(12) United States Patent
Gérard et al.

(10) Patent No.: US 10,662,393 B2
(45) Date of Patent: May 26, 2020

(54) METHOD AND COMPOSITION FOR AN ANION TOLERANT LUBRICANT

(71) Applicant: Diversey, Inc., Fort Mill, SC (US)

(72) Inventors: Nathalie Gérard, Plankstadt (DE); Stefan Grober, Frankenthal (DE); Markus Wloka, Essen (DE); Henry Von Rège, Alsey (DE); Chivukula V. S. N. Murthy, Mumbai (IN); Hemant Godbole, Mumbai (IN)

(73) Assignee: Diversey, Inc., Fort Mill, SC (US)

( * ) Notice: Subject to any disclaimer, the term of this patent is extended or adjusted under 35 U.S.C. 154(b) by 197 days.

(21) Appl. No.: 15/735,561

(22) PCT Filed: May 4, 2016

(86) PCT No.: PCT/US2016/030715

§ 371 (c)(1),
(2) Date: Dec. 11, 2017

(87) PCT Pub. No.: WO2016/191056

PCT Pub. Date: Dec. 1, 2016

(65) Prior Publication Data

US 2018/0282657 A1 Oct. 4, 2018

Related U.S. Application Data

(60) Provisional application No. 62/165,662, filed on May 22, 2015, provisional application No. 62/232,880, filed on Sep. 25, 2015.

(51) Int. Cl.
*C10M 173/02* (2006.01)

(52) U.S. Cl.
CPC ..... *C10M 173/025* (2013.01); *C10M 2207/0203* (2013.01); *C10M 2207/046* (2013.01);

(Continued)

(58) Field of Classification Search
CPC ..... C10M 2215/08; C10M 2207/046; C10M 2207/122; C10M 2215/04; C10M 2223/04; C10N 2240/52
See application file for complete search history.

(56) References Cited

U.S. PATENT DOCUMENTS 5,458,698 A * 10/1995 Bershas ..... C10M 105/22 148/246
5,510,045 A * 4/1996 Remus ..... C10M 133/08 508/558

(Continued)

FOREIGN PATENT DOCUMENTS

| | | | |
|---|---|---|---|
| JP | 2008106253 | A | 5/2008 |
| WO | WO-2005/014764 | A1 | 2/2005 |
| WO | WO-2009/041014 | A1 | 4/2009 |

OTHER PUBLICATIONS

International Search Report and Written Opinion for International Application No. PCT/US2016/030715 dated Sep. 27, 2016 (19 pages).

*Primary Examiner* — Vishal V Vasisth
(74) *Attorney, Agent, or Firm* — Bell & Manning, LLC; N. Meredith Porembski

(57) ABSTRACT

The presently disclosed subject matter Is directed to formulations for lubricating a conveyor belt used in beverage packaging. One of the disclosed lubricant compositions comprises water, at least one amphoteric surfactant, at least one anionic surfactant and at least one non-ionic surfactant. Also disclosed is a system for applying a lubricant to a conveyor belt and a method for lubricating a conveyor belt.

34 Claims, 15 Drawing Sheets

(52) U.S. Cl.
CPC . *C10M 2207/0406* (2013.01); *C10M 2207/10* (2013.01); *C10M 2207/122* (2013.01); *C10M 2207/124* (2013.01); *C10M 2207/128* (2013.01); *C10M 2209/103* (2013.01); *C10M 2209/104* (2013.01); *C10M 2209/1045* (2013.01); *C10M 2215/02* (2013.01); *C10M 2215/04* (2013.01); *C10M 2215/08* (2013.01); *C10M 2215/10* (2013.01); *C10M 2219/042* (2013.01); *C10M 2219/044* (2013.01); *C10M 2219/104* (2013.01); *C10M 2223/04* (2013.01); *C10N 2230/00* (2013.01); *C10N 2230/06* (2013.01); *C10N 2230/62* (2013.01); *C10N 2240/52* (2013.01)

(56) References Cited

U.S. PATENT DOCUMENTS

| | | | | |
|---|---|---|---|---|
| 5,863,874 | A | 1/1999 | Person Hei et al. | |
| 2005/0119139 | A1* | 6/2005 | Ciampi | C10M 141/06 508/559 |
| 2009/0029886 | A1* | 1/2009 | Chiba | C10M 173/025 508/283 |

* cited by examiner

METHOD AND COMPOSITION FOR AN ANION TOLERANT LUBRICANT

This application is a 371 of PCT/US2016/030715, filed May 4, 2016 which claims benefit of 62/165,662 filed May 22, 2015 and claims benefit of 62/232,880 filed Sep. 25, 2015.

FIELD OF THE INVENTION

The presently disclosed subject matter relates generally to a formulation for lubricating a conveyor belt used in beverage packaging and methods of lubricating a conveyor belt.

BACKGROUND

Conveyors used in food packaging and beverage factories are required to transport corresponding vessels. Beverage factories have also started using recycled water from bottle washers for treatment of the conveyor track. These conveyors are often conveyor belts and chain conveyors that may need adequate lubrication which does not interfere with performance or quality of the products. Recycled water can be from pre-final rinse bottle wash tanks where the water is recovered using sand filtration, disinfection, activated carbon filtration, de-aeration and sodium ion exchange to remove alkalinity. Some plants may use reverse osmosis techniques to remove sodium hydroxide. De-alkalized water is then mixed with fresh water to provide the required demand. The ratio of both water qualities varies as well as the levels of potential process critical anions like sulfates or phosphates (carried over from bottle washing detergents) and therefore some plants do not consider this recycled water for conveyor treatment. Also, current lubricant compositions often have problems with anion tolerance in recycled water and/or performance issues, furthering the decision to not use this recycled water for conveyors.

Specifically, lubricants may form precipitates when exposed to recycled water that contains high levels of anions, such as sulfate and phosphate. Lubricants can also have free fatty acids, which can degrade floor grout in a factory. Further, lubricants may be unstable in the presence of preferred isothiazolinone types of non-oxidizing biocides.

Sustainability has been gaining more prominence and it is expected that all beverage plants will implement a water recycling plant as several prominent beverage plants have already started using recycled water. Thus, a lubricant formulation that could overcome all of the above-mentioned limitations would offer an improved lubricant formulation that would be very beneficial for use with conveyor belts and chain conveyors. The presently disclosed matter offers an anion tolerant lubricant which has improved lubrication performance.

SUMMARY

The presently disclosed subject matter is directed to a lubricant composition including 65 wt % to 95 wt % water, 1 wt % to 25 wt % of at least one amphoteric surfactant, 1 wt % to 10 wt % of at least one anionic surfactant and 0.5 wt % to 10 wt % of at least one non-ionic surfactant.

In some embodiments, the presently disclosed subject matter is directed to a system for applying a lubricant to a conveyor belt. The system may be a container with a lubricant composition including 65 wt % to 95 wt % water, 1 wt % to 25 wt % of at least one amphoteric surfactant, 1 wt % to 10 wt % of at least one anionic surfactant and 0.5 wt % to 10 wt % of at least one non-ionic surfactant; and a device to dispense the lubricant composition from the container to the conveyor belt.

In some embodiments, the presently disclosed subject matter is directed to a method of lubricating a conveyor belt. The method may include applying a lubricant composition including 65 wt % to 95 wt % water, 1 wt % to 25 wt % of at least one amphoteric surfactant, 1 wt % to 10 wt % of at least one anionic surfactant and 0.5 wt % to 10 wt % of at least one non-ionic surfactant to a conveyor belt where recycled water with anions may be in contact with the conveyor belt and the lubricant composition may have a coefficient of friction of less than 0.3 when lubricating the conveyor belt.

In some embodiments, a method of lubricating a conveyor belt may include applying a lubricant composition with 65 wt % to 95 wt % water, 2 wt % to 5 wt % of N-coco, 1,3-diaminopropane, 0.5 wt % to 10 wt % of N-lauroyl sarcosinic acid sodium salt, 0.5 wt % to 5 wt % of at least one non-ionic surfactant, 0.5 wt % to 5 wt % of a buffer, and 0.5 wt % to 3 wt % of a phosphate ester to a conveyor belt where recycled water with anions may be in contact with the conveyor belt. The lubricant composition may have a coefficient of friction of less than 0.3 when lubricating the conveyor belt.

The presently disclosed subject matter is directed to a lubricant composition including 65 wt % to 95 wt % water, 1 wt % to 25 wt % of at least one amphoteric surfactant, 2 wt % to 5 wt % of N-coco, 1,3-diaminopropane, 1 wt % to 5 wt % of at least one buffer and 0.2 wt % to 5 wt % of at least one additive.

In some embodiments, the presently disclosed subject matter is directed to a system for applying a lubricant to a conveyor belt. The system may be a container with a lubricant composition including 65 wt % to 95 wt % water, 1 wt % to 25 wt % of at least one amphoteric surfactant, 2 wt % to 5 wt % of N-coco, 1,3-diaminopropane, 1 wt % to 5 wt % of at least one buffer and 0.2 wt % to 5 wt % of at least one additive; and a device to dispense the lubricant composition from the container to the conveyor belt.

In some embodiments, the presently disclosed subject matter is directed to a method of lubricating a conveyor belt. The method may include applying a lubricant composition including 65 wt % to 95 wt % water, 1 wt % to 25 wt % of at least one amphoteric surfactant, 2 wt % to 5 wt % of N-coco, 1,3-diaminopropane, 1 wt % to 5 wt % of at least one buffer and 0.2 wt % to 5 wt % of at least one additive to a conveyor belt where recycled water with anions may be in contact with the conveyor belt. The lubricant composition may have a coefficient of friction of less than 0.3 when lubricating the conveyor belt.

The presently disclosed subject matter is directed to a lubricant composition including 65 wt % to 95 wt % water, 0.5 wt % to 15 wt % of at least one cationic surfactant, 2 wt % to 5 wt % of at least one non-ionic surfactant, 1 wt % to 5 wt % of at least one buffer and 0.2 wt % to 5 wt % of at least one additive.

In some embodiments, the presently disclosed subject matter is directed to a system for applying a lubricant to a conveyor belt. The system may be a container with a lubricant composition including 65 wt % to 95 wt % water, 0.5 wt % to 15 wt % of at least one cationic surfactant, 2 wt % to 5 wt % of at least one non-ionic surfactant, 1 wt % to 5 wt % of at least one buffer and 0.2 wt % to 5 wt % of at least one additive and a device to dispense the lubricant composition from the container to the conveyor belt.

In some embodiments, the presently disclosed subject matter is directed to a method of lubricating a conveyor belt. The method may include applying a lubricant composition including 65 wt % to 95 wt % water, 0.5 wt % to 15 wt % of at least one cationic surfactant, 2 wt % to 5 wt % of at least one non-ionic surfactant, 1 wt % to 5 wt % of at least one buffer and 0.2 wt % to 5 wt % of at least one additive to a conveyor belt where recycled water with anions is in contact with the conveyor belt. The lubricant composition may have a coefficient of friction of less than 0.3 when lubricating the conveyor belt.

DETAILED DESCRIPTION

I. General Considerations

Figure 1:
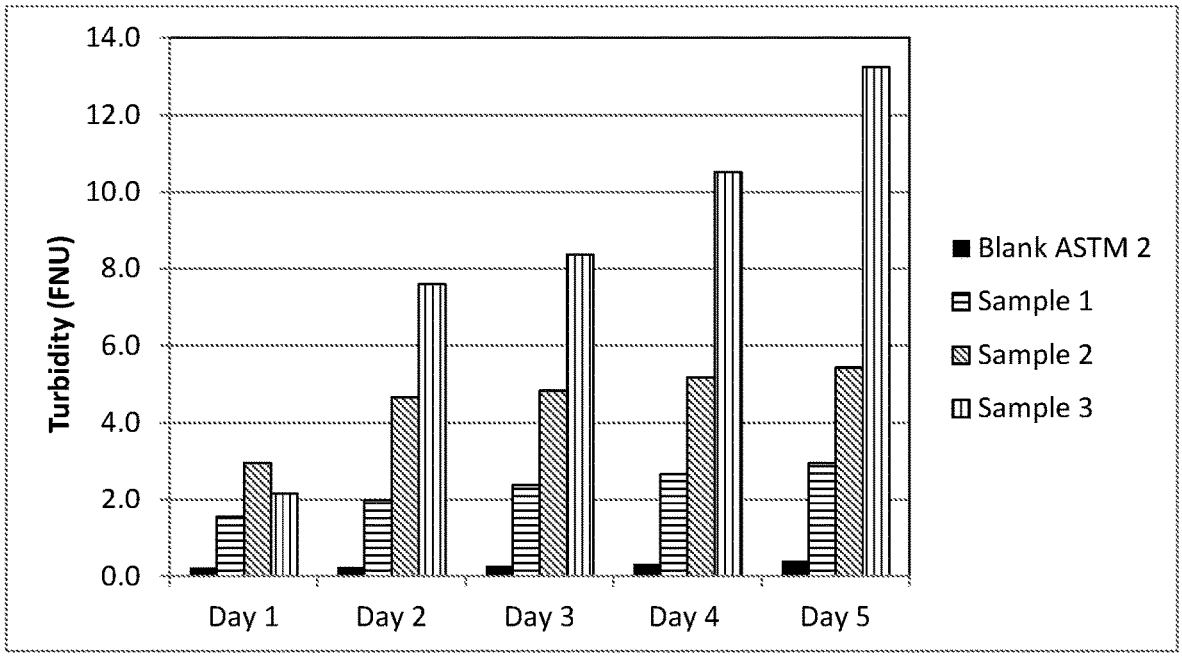
FIG. 1 is a bar graph that illustrates the turbidity values of lubricant compositions over a 5 day time period in ASTM 2 water.

The presently disclosed subject matter is directed to a lubricant composition. The lubricant composition may include water, at least one amphoteric surfactant, at least one anionic surfactant, and at least one non-ionic surfactant.

II. Definitions

While the following terms are believed to be well understood by one of ordinary skill in the art, the following definitions are set forth to facilitate explanation of the presently disclosed subject matter.

Unless defined otherwise, all technical and scientific terms used herein have the same meaning as commonly understood to one of ordinary skill in the art to which the presently disclosed subject matter belongs.

Following long standing patent law convention, the terms "a", "an", and "the" refer to "one or more" when used in the subject application, including the claims. Thus, for example, reference to "a composition" includes a plurality of such compositions, and so forth.

Unless indicated otherwise, all numbers expressing quantities of components, reaction conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, percentage, and the like can encompass variations of, and in some embodiments, ±20%, in some embodiments ±10%, in some embodiments ±5%, in some embodiments ±1%, in some embodiments ±0.5%, and in some embodiments ±0.1%, from the specified amount, as such variations are appropriated in the disclosed formulation, system and methods.

As used herein, the term "additive" refers to any substance, chemical, compound or formulation that is added to an initial substance, chemical, compound or formulation in a smaller amount than the initial substance, chemical, compound or formulation to provide additional properties or to change the properties of the initial substance, chemical, compound or formulation.

As used herein, the term "perfume" refers to any odoriferous material or any material which acts as a malodor counteractant. In general, such materials are characterized by a vapor pressure greater than atmospheric pressure at ambient temperatures. The perfume may also be referred to as a fragrance, odorant, essential oil, cologne or eau de toilette.

As used herein, the term "preservative" refers to any chemical or compound that prevents degradation or breakdown of a compound, composition or formulation. A preservative also prevents decomposition by microbial growth or undesirable chemical changes of a compound, composition or formulation during storage or use.

As used herein, the term "antimicrobial" refers to any chemical or compound that kills or inhibits the growth of microorganisms.

As used herein, the term "buffer" refers to any chemical, compound, or solution that is used to control the pH of a composition, formulation, system or solution. A "buffer system" refers to any composition or system where there are two or more components that are used to control the pH of a composition, formulation, system, or solution, such as an acid and a base. The components are any chemical, compound, formulation or solution.

As used herein, the term "recycled water" refers to any water that has been used more than once. Recycled water is inclusive of water that has been treated such as waste water, wash water or rinse water that is treated to remove solids and impurities. Recycled water can have anions, such as, for example sulfates and phosphates.

All compositional percentages used herein are presented on a "by weight" basis, unless designated otherwise.

Although the majority of the above definitions are substantially as understood by those of skill in the art, one or more of the above definitions can be defined hereinabove in a manner differing from the meaning as ordinarily understood by those of skill in the art, due to the particular description herein of the presently disclosed subject matter.

III. The Disclosed Composition

The presently disclosed composition is directed to a lubricant composition. The lubricant composition may be comprised of water, at least one amphoteric surfactant, at least one anionic surfactant and at least one non-ionic surfactant. In some embodiments, the lubricant composition may be comprised of water, at least one amphoteric surfactant, N-coco, 1,3-diaminopropane, at least one buffer and at least one additive. In other embodiments, the lubricant composition may be comprised of water, at least one cationic surfactant, at least one non-ionic surfactant, at least one buffer and at least one additive.

The lubricant composition may include a liquid medium. The liquid medium may be water. The water may be sterile water, deionized water, demineralized water, distilled water, soft water, hard water, recycled water or any combination thereof. The lubricant composition may have 50 wt % water, 55 wt % water, 60 wt % water, 65 wt % water, 70 wt % water, 74 wt % water, 75 wt % water, 80 wt % water, 81 wt % water, 82 wt % water, 83 wt % water, 84 wt % water, 85 wt % water, 86 wt % water, 87 wt % water, 88 wt % water, 89 wt % water, 90 wt % water, 90.85 wt % water, 91 wt % water, 94 wt % water, 95 wt % water or any range between any of these values. In some embodiments, the lubricant composition may include 65 wt % to 95 wt % water. In other embodiments, the lubricant composition may include 91 wt % water. In further embodiments, the lubricant composition may include 94 wt % water. In some embodiments, the lubricant composition may include 89.62 wt % water. In some embodiments, the lubricant composition may include 80.5 wt % water. In some embodiments, the lubricant composition may include 82 wt % water. In some embodiments, the lubricant composition may include 86.2 wt % water. In some embodiments, the lubricant composition may include 87.7 wt % water. In other embodiments, the lubricant composition may include 93.74 wt % water.

The lubricant composition may include at least one amphoteric surfactant. The at least one amphoteric surfactant may be a dipropionate, a monopropionate, an amino betaine, an amido betaine, their salts and combinations thereof. In some embodiments, the at least one amphoteric surfactant may be β-alanine, N-(2-carboxyethyl)N-tallow alkyl derivative or β-alanine, N-(2-carboxyethyl)N-(2-ethylhexyl) monosodium salt. In further embodiments, the at least one amphoteric surfactant may be alkyl (C8) amino dipropionate monosodium salt and cocamidopropyl betaine.

In some embodiments, the lubricant composition may include 1 wt % of at least one amphoteric surfactant, 1.8 wt % of at least one amphoteric surfactant, 2 wt % of at least one amphoteric surfactant, 2.5 wt % of at least one amphoteric surfactant, 2.8 wt % of at least one amphoteric surfactant, 3 wt % of at least one amphoteric surfactant, 4.6 wt % of at least one amphoteric surfactant, 5 wt % of at least one amphoteric surfactant, 6 wt % of at least one amphoteric surfactant, 7.5 wt % of at least one amphoteric surfactant, 10 wt % of at least one amphoteric surfactant, 12.5 wt % of at least one amphoteric surfactant, 13.5 wt % of at least one amphoteric surfactant, 15 wt % of at least one amphoteric surfactant, 16.5 wt % of at least one amphoteric surfactant, 18 wt % of at least one amphoteric surfactant, 19.5 wt % of at least one amphoteric surfactant, 20 wt % of at least one amphoteric surfactant, 21.5 wt % of at least one amphoteric surfactant, 23 wt % of at least one amphoteric surfactant, 25 wt % of at least one amphoteric surfactant or any range between any of these values. In other embodiments, the lubricant composition may include 2 wt % to 25 wt % of at least one amphoteric surfactant. In further embodiments, the lubricant composition may include 1.2 wt % β-alanine, N-(2-carboxyethyl)N-(2-ethylhexyl) monosodium salt and 4.95 wt % β-alanine, N-(2-carboxyethyl)N-tallow alkyl derivative. In further embodiments, the lubricant composition may include 3 wt % β-alanine, N-(2-carboxyethyl)N-(2-ethylhexyl) monosodium salt and 16.5 wt % β-alanine, N-(2-carboxyethyl)N-tallow alkyl derivative. In some embodiments, the at least one amphoteric surfactant may include 1 wt % alkyl (C8) amino dipropionate monosodium salt and 1.8 wt % cocamidopropyl betaine. In other embodiments, the at least one amphoteric surfactant may include 4.6 wt % N-oleyl-1,3-diaminopropane.

The lubricant composition may include at least one anionic surfactant. The at least one anionic surfactant may be an N-acyl-sarcosinate, an alkylethercarboxylate, an alkane sulphonate, an alkyl sulfate, an alkyl sulphonate, an alkyl ether sulfate, a branched alkyl benzene sulphonate, a linear alkyl benzene sulphonate, their salts and combinations thereof. In some embodiments, the at least one anionic surfactant may be N-lauroyl sarcosinic acid sodium salt.

In some embodiments, the lubricant composition may include 1 wt % of at least one anionic surfactant, 1.5 wt % of at least one anionic surfactant, 2 wt % of at least one anionic surfactant, 3 wt % of at least one anionic surfactant, 4 wt % of at least one anionic surfactant, 5 wt % of at least one anionic surfactant, 6 wt % of at least one anionic surfactant, 7 wt % of at least one anionic surfactant, 8 wt % of at least one anionic surfactant, 9 wt % of at least one anionic surfactant, 10 wt % of at least one anionic surfactant, 11 wt % of at least one anionic surfactant, 12 wt % of at least one anionic surfactant, 15 wt % of at least one anionic surfactant or any range between any of these values. In other embodiments, the lubricant composition may include 2 wt % to 10 wt % of at least one anionic surfactant. In further embodiments, the lubricant composition may include 5 wt % of at least one anionic surfactant. The lubricant composition may include 1.5 wt % N-lauroyl sarcosinic acid sodium salt. The lubricant composition may include 0.9 wt % N-lauroyl sarcosinic acid sodium salt.

The lubricant composition may include at least one non-ionic surfactant. The at least one non-ionic surfactant may be a fatty alcohol polyglycoside, a linear alcohol ethoxylate, a branched alcohol ethoxylate, an alkyl phenol ethoxylate, cetyl alcohol, an alcohol alkoxylate and combinations thereof. In some embodiments, the at least one non-ionic surfactant may be an alcohol alkoxylate. In some embodiments, the at least one non-ionic surfactant may be an alcohol ethoxylate.

In some embodiments, the lubricant composition may include 0.5 wt % of at least one non-ionic surfactant, 1 wt % of at least one non-ionic surfactant, 1.5 wt % of at least one non-ionic surfactant, 2 wt % of at least one non-ionic surfactant, 2.5 wt % of at least one non-ionic surfactant, 3 wt % of at least one non-ionic surfactant, 3.5 wt % of at least one non-ionic surfactant, 4 wt % of at least one non-ionic surfactant, 4.5 wt % of at least one non-ionic surfactant, 5 wt % of at least one non-ionic surfactant or any range between any of these values. In other embodiments, the lubricant composition may include 0.5 wt % to 10 wt % of at least one non-ionic surfactant. The lubricant composition may include 1 wt % alcohol alkoxylate. The lubricant composition may include 1.5 wt % alcohol alkoxylate. The lubricant composition may include 4.0 wt % alcohol ethoxylate. The lubricant composition may include 4.0 wt % alcohol (C13) ethoxylate (12EO).

The lubricant composition may include at least one cationic surfactant. The at least one cationic surfactant may be a diaminopropane, a fatty-alkyl amine, their salts and combinations thereof. In some embodiments, the at least one cationic surfactant may be N-coco, 1,3-diaminopropane. In some embodiments, the at least one cationic surfactant may be N,N-bis(3-aminopropyl) dodecylamine. In some embodiments, the at least one cationic surfactant may be a diamine. In other embodiments, the at least one cationic surfactant may be a diamine and an alkylamine. The diamine may be N-coco-1,3-diaminopropane. The alkylamine may be N-oleyl-1,3-diaminopropane. The diamine may be N-coco-1,3-diaminopropane and N-oleyl-1,3-diaminopropane. The alkylamine may be N,N-bis (3-aminopropyl) dodecylamine. In some embodiments, the at least one cationic surfactant may be N,N-bis(3-aminopropyl) dodecylamine and N-oleyl-1,3-diaminopropane. The cationic surfactant may also provide biocidal properties. If the cationic surfactant is N,N-bis(3-aminopropyl) dodecylamine it may act as a biocide.

In some embodiments, the lubricant composition may include 0.5 wt % of at least one cationic surfactant, 1 wt % of at least one cationic surfactant, 1.5 wt % of at least one cationic surfactant, 2 wt % of at least one cationic surfactant, 3 wt % of at least one cationic surfactant, 4 wt % of at least one cationic surfactant, 5 wt % of at least one cationic surfactant, 10 wt % of at least one cationic surfactant, 15 wt % of at least one cationic surfactant or any range between any of these values. In other embodiments, the lubricant composition may include 3 wt % of at least one cationic surfactant. In further embodiments, the lubricant composition may include 0.5 wt % to 15 wt % of at least one cationic surfactant. The lubricant composition may include 2.8 wt % N-coco, 1,3-diaminopropane. The lubricant composition may include 2.8 wt % N-oleyl-1,3-diaminopropane. In some embodiments, the lubricant composition may include 4.6 wt % N-coco, 1,3-diaminopropane. In other embodiments, the lubricant composition may include 1.5 wt % N,N-bis(3-aminopropyl) dodecylamine. In other embodiments, the lubricant composition may include 4.6 wt % N,N-bis(3-aminopropyl) dodecylamine. In further embodiments, the lubricant composition may include 4.6 wt % N-oleyl-1,3-diaminopropane.

The lubricant composition may have at least one additive. In some embodiments, the lubricant composition may include 0.021 wt % of at least one additive, 0.04 wt % of at least one additive, 0.05 wt % of at least one additive, 0.07 wt % of at least one additive, 0.1 wt % of at least one additive, 0.2 wt % of at least one additive, 0.25 wt % of at least one additive, 0.5 wt % of at least one additive, 0.7 wt % of at least one additive, 1 wt % of at least one additive, 1.5 wt % of at least one additive, 2 wt % of at least one additive, 4.2 wt % of at least one additive, 5 wt % of at least one additive or any range between any of these values. In other embodiments, the lubricant composition may include 0.061 wt % of at least one additive. In further embodiments, the lubricant composition may include 1.6 wt % of at least one additive. The at least one additive may be an antimicrobial, a biocide, a buffer, a chelating agent, a colorant, a perfume, a preservative, a phosphate ester, a solvent and combinations thereof.

In some embodiments, the lubricant composition may have at least one buffer. The additive may be a buffer. In some embodiments, the buffer may be a carboxylic acid, such as, for example acetic acid, glycolic acid, formic acid and combinations thereof. In some embodiments, the carboxylic acid may be acetic acid. The lubricant composition may include 0.5 wt % of a buffer, 0.6 wt % of a buffer, 0.7 wt % of a buffer, 0.8 wt % of a buffer, 0.9 wt % of a buffer, 1 wt % of a buffer, 1.5 wt % of a buffer, 1.98 wt % of a buffer, 2 wt % of a buffer, 2.5 wt % of a buffer, 2.7 wt % of a buffer, 3 wt % of a buffer, 3.2 wt % of a buffer, 5 wt % of a buffer or any range between any of these values. In a preferred embodiment, the lubricant composition may include 0.9 wt % acetic acid. In other embodiments, the lubricant composition may include 1.98 wt % acetic acid. In further embodiments, the lubricant composition may include 2.7 wt % acetic acid.

The additive may also be at least one chelating agent. In some embodiments, the at least one chelating agent may be diethylene triamine pentaacetic acid, ethylenediaminetetraacetate, diethylene triamine penta (methylene phosphonic) acid, ethylene diamine tetra (methylene phosphonic) acid, ethylene diamine disuccinic acid, 1-hydroxyethane-1,1-diphosphonic acid (HEDP), methylglycine diacetic acid (MGDA), nitrilotriacetic acid, their salts and combinations thereof.

The additive may also be at least one perfume. The perfume may provide an odor or fragrance that is appealable to a person or neutralize odors of a composition or of a product that may come in contact with the composition. The perfume may be any natural or synthetic perfume that is well known. For example, in some embodiments, the perfume may be a flower or herbal fragrance, such as rose extract, violet extract, and/or lavender extract; a fruit fragrance, such as lemon, lime, and/or orange; synthetic perfumes, such as musk ketone, musk xylol, aurantiol, and/or ethyl vanillin. The perfume may be from a wide variety of chemicals, such as aldehydes, ketones, esters, and the like.

The additive may be at least one preservative or antimicrobial. In some embodiments, the at least one preservative or antimicrobial may be a carbamate, a quaternary ammonium compound, an alkyl amine, an isothiazoline and combinations thereof. The isothiazoline may be benzylisothiazolinone, 5-chloroisothiazolinone, methylisothiazolinone and combinations thereof. In other embodiments, the preservative may be 1,2-benzisothiazolin-3-one sodium salt and 3-iodo-2-propynyl butyl carbamate. The lubricant composition may include 0.021 wt % of at least one preservative, 0.025 wt % of at least one preservative, 0.04 wt % of at least one preservative, 0.05 wt % of at least one preservative, 0.07 wt % of at least one preservative, 0.1 wt % of at least one preservative, 0.2 wt % of at least one preservative, 0.27 wt % of at least one preservative, 0.3 wt % of at least one preservative, 0.4 wt % of at least one preservative, 0.5 wt % of at least one preservative or any range between any of these values. In a preferred embodiment, the lubricant composition may include 0.04 wt % wt % 1,2-benzisothiazolin-3-one sodium salt and 0.021 wt % 3-iodo-2-propynyl butyl carbamate.

The additive may also be a phosphate ester. The lubricant composition may include 0.5 wt % of a phosphate ester, 0.6 wt % of a phosphate ester, 0.7 wt % of a phosphate ester, 0.8 wt % of a phosphate ester, 0.9 wt % of a phosphate ester, 1 wt % of a phosphate ester, 1.5 wt % of a phosphate ester, 2 wt % of a phosphate ester, 3 wt % of a phosphate ester or any range between any of these values. In some embodiments, the phosphate ester may be tributoxyethyl phosphate. In a preferred embodiment, the lubricant composition may include 0.7 wt % tributoxyethyl phosphate. In some embodiments, the lubricant composition may include 1 wt % tributoxyethyl phosphate.

The additive may also be at least one solvent. In some embodiments, the at least one solvent may be water, polyethylene glycol, alcohol, ether, polyether and combinations thereof. In other embodiments, the solvent may be water.

In some embodiments, the lubricant composition may include 90.85 wt % water, 1.2 wt % β-alanine, N-(2-carboxyethyl)N-(2-ethylhexyl) monosodium salt, 4.95 wt % β-alanine, N-(2-carboxyethyl)N-tallow alkyl derivative, 1.5 wt % N-lauroyl sarcosinic acid sodium salt, 1.5 wt % alcohol alkoxylate. In other embodiments the lubricant composition may include 90.85 wt % water, 1.2 wt % β-alanine, N-(2-carboxyethyl)N-(2-ethylhexyl) monosodium salt, 4.95 wt % β-alanine, N-(2-carboxyethyl)N-tallow alkyl derivative, 1.5 wt % N-lauroyl sarcosinic acid sodium salt, 1.5 wt % alcohol alkoxylate, 0.04 wt % 1,2-benzisothiazolin-3-one sodium salt and 0.021 wt % 3-iodo-2-propynyl butyl carbamate. In some embodiments, the percentage of water in the lubricant composition may be based upon a water dilution needed to have a total weight percent of 100 for the lubricant composition.

In some embodiments, the lubricant composition may include 89.62 wt % water, 4.6 wt % N-coco, 1,3-diaminopropane, 1.8 wt % cocamidopropyl betaine, 1 wt % alkyl (C8) amino dipropionate monosodium salt, 1.98 wt % acetic acid and 1 wt % tributoxyethyl phosphate.

In some embodiments, the lubricant composition may include 86.2 wt % water, 2.7 wt % acetic acid, 4.6 wt % N-oleyl-1,3-diaminopropane, 4.0 wt % alcohol (C13) ethoxylate (12EO), 1.5 wt % N,N-bis(3-aminopropyl)dodecylamine and 1 wt % tributoxyethyl phosphate. In other embodiments, the lubricant composition may include 87.7 wt % water, 2.7 wt % acetic acid, 4.6 wt % N-oleyl-1,3-diaminopropane, 4.0 wt % alcohol (C13) ethoxylate (12EO) and 1 wt % tributoxyethyl phosphate.

IV. The Disclosed System

The disclosed lubricant composition may be used in a system for applying a lubricant to a conveyor belt. The system may include a container with a lubricant composition as described previously. The system may also include a device to dispense the lubricant composition from the container to the conveyor belt. In some embodiments, the system may be attached to the conveyor belt. In other embodiments, the system may not be attached to the conveyor belt.

The system may be used for lubricating and cleaning of feed and conveyors in the food industry and the beverage industry. The system may be used for any bottle and/or can conveyors well known in the art. The bottles and/or cans may be made from metal, glass, paper, cardboard, plastic and combinations thereof. In some embodiments, the bottles and/or cans may include glass, polyethylene terephthalate (PET), polyethylene naphthalate (PEN) or polycarbonate (PC), boxes, crates, metal cans, vessels, refillable cans, barrels or vessels, such as KEGs, beverage containers, paper and cardboard holders and the like.

The container may be of any shape. For example, the container may be in the shape of a circle, a diamond, an oval, a square, a rectangle, a pentagon, a hexagon, a heptagon, an octagon or combinations thereof. The device to dispense the lubricant may include a dispensing nozzle. In some embodiments, the dispensing nozzle may be connected to the container. In other embodiments, the dispensing nozzle may not be connected to the container. The lubricant may be pumped from the container and dispensed from the nozzle.

V. Methods of Using the Disclosed Composition

A method of lubricating a conveyor belt may include applying a lubricant composition as described above to a conveyor belt. The lubricant composition may be applied as dry, semi-dry or wet lubricant.

In some embodiments, a lubricant composition may include 65 wt % to 95 wt % water, 1 wt % to 25 wt % of at least one amphoteric surfactant, 1 wt % to 10 wt % of at least one anionic surfactant and 0.5 wt % to 10 wt % of at least one non-ionic surfactant. In a preferred embodiment, the lubricant composition may include 91 wt % water, 1.2 wt % β-alanine, N-(2-carboxyethyl)N-(2-ethylhexyl) monosodium salt, 5 wt % β-alanine, N-(2-carboxyethyl)N-tallow alkyl derivative, 1.5 wt % N-lauroyl sarcosinic acid sodium salt, 1.5 wt % alcohol alkoxylate. In some embodiments, the lubricant composition may include 91 wt % water, 1.2 wt % β-alanine, N-(2-carboxyethyl)N-(2-ethylhexyl) monosodium salt, 5 wt % β-alanine, N-(2-carboxyethyl)N-tallow alkyl derivative, 1.5 wt % N-lauroyl sarcosinic acid sodium salt, 1.5 wt % alcohol alkoxylate, 0.04 wt % 1,2-benzisothiazolin-3-one sodium salt and 0.021 wt % 3-iodo-2-propynyl butyl carbamate.

In other embodiments, the lubricant composition may include 65 wt % to 95 wt % water, 2 wt % to 5 wt % N-coco, 1,3-diaminopropane, 0.5 wt % to 10 wt % N-lauroyl sarcosinic acid sodium salt, 0.5 wt % to 5 wt % of at least one non-ionic surfactant, 0.5 wt % to 5 wt % of a buffer; and 0.5 wt % to 3 wt % of a phosphate ester. The non-ionic surfactant may be alcohol alkoxylate. The phosphate ester may be tributoxyethyl phosphate. In a preferred embodiment, the lubricant composition may include 93.7 wt % water, 2.8 wt % N-coco, 1,3-diaminopropane, 0.9 wt % N-lauroyl sarcosinic acid sodium salt, 1 wt % alcohol alkoxylate, 0.9 wt % acetic acid and 0.7 wt % tributoxyethyl phosphate.

In some embodiments, a lubricant composition may include 65 wt % to 95 wt % water, 1 wt % to 25 wt % of at least one amphoteric surfactant, 1 wt % to 5 wt % of at least one buffer and 0.2 wt % to 5 wt % of at least one additive. In a preferred embodiment, the lubricant composition may include 89.62 wt % water, 4.6 wt % N-coco, 1,3-diaminopropane, 1.8 wt % cocamidopropyl betaine, 1 wt % alkyl (C8) amino dipropionate monosodium salt, 1.98 wt % acetic acid and 1 wt % tributoxyethyl phosphate.

In some embodiments, a lubricant composition may include 65 wt % to 95 wt % water, 0.5 wt % to 15 wt % of at least one cationic surfactant, 2 wt % to 5 wt % of at least one non-ionic surfactant, 1 wt % to 5 wt % of at least one buffer and 0.2 wt % to 5 wt % of at least one additive. In a preferred embodiment, the lubricant composition may include 80.5 wt % water, 2.7 wt % acetic acid, 4.6 wt % N-oleyl-1,3-diaminopropane, 4.0 wt % alcohol (C13) ethoxylate (12EO), 1 wt % tributoxyethyl phosphate and 1.5 wt % N,N-bis (3-aminopropyl) dodecylamine. In a preferred embodiment, the lubricant composition may include 82 wt % water, 2.7 wt % acetic acid, 4.6 wt % N-oleyl-1,3-diaminopropane, 4.0 wt % alcohol (C13) ethoxylate (12EO) and 1 wt % tributoxyethyl phosphate. In a preferred embodiment, the lubricant composition may include 86.2 wt % water, 2.7 wt % acetic acid, 4.6 wt % N-oleyl-1,3-diaminopropane, 4.0 wt % alcohol (C13) ethoxylate (12EO), 1.5 wt % N,N-bis(3-aminopropyl)dodecylamine and 1 wt % tributoxyethyl phosphate. In a preferred embodiment, the lubricant composition may include 87.7 wt % water, 2.7 wt % acetic acid, 4.6 wt % N-oleyl-1,3-diaminopropane, 4.0 wt % alcohol (C13) ethoxylate (12EO) and 1 wt % tributoxyethyl phosphate.

The conveyor belt may be in contact with recycled water with anions. In some embodiments, a method of lubricating a conveyor belt may include applying the lubricant composition as described previously to the conveyor belt where recycled water with anions is in contact with the conveyor belt. In other embodiments, the method may also include a lubricant composition as described previously having a coefficient of friction of less than 0.3 when lubricating the conveyor belt.

Lubricant formulations often show decreased water compatibility when contacted with recycled water with high levels of anions. Water compatibility is commonly measured by turbidity measurements given in Formazin Nephelometric Units (FNU). Values below 10 FNU are considered clear and can be accepted as water compatible. Low turbidity measurements (<10 FNU) over a prolonged period of time are indicators of anion tolerance of a lubricant composition. Low turbidity measurements indicate minimal precipitate formation during use of the lubricant composition.

Another indicator of lubricant performance is the coefficient of friction ($\mu$). A low coefficient of friction sustained over a prolonged period of time indicates the lubricant has good performance. In some embodiments, the lubricant composition may have a coefficient of friction of less than 0.3 when lubricating the conveyor belt. In other embodiments, the lubricant composition may have a coefficient of friction of less than 0.2 when lubricating the conveyor belt. In further embodiments, the lubricant composition may have a coefficient of friction of about 0.1 to about 0.16 when lubricating the conveyor belt.

The lubricant composition may be continuously applied onto the conveyor belt. In some embodiments, the lubricant composition may not be continuously applied onto the conveyor belt. The lubricant composition may be intermittently applied onto the conveyor belt. In some embodiments, the lubricant composition may be applied to the conveyor belt during an application time and is not applied to the conveyor belt during a non-application time. The ratio of application time to non-application time may be between a ratio of 1:0 to 1:100. The ratio of application time to non-application time may be between a ratio of 1:5 to 1:60. In some embodiments, the ratio of application time to non-application time may be a ratio of 1:0, a ratio of 1:1, a ratio of 1:2, a ratio of 1:3, a ratio of 1:4, a ratio of 1:5, a ratio of 1:6, a ratio of 1:7, a ratio of 1:10, a ratio of 1:15, a ratio of 1:20, a ratio of 1:25, a ratio of 1:30, a ratio of 1:40, a ratio of 1:50, a ratio of 1:60, a ratio of 1:70, a ratio of 1:80, a ratio of 1:90, a ratio of 1:100 or any range between any of these values. In other embodiments, the ratio of application time to non-application time may be a ratio of 100:1, a ratio of 90:1, a ratio of 80:1, a ratio of 70:1, a ratio of 60:1, a ratio of 50:1, a ratio of 40:1, a ratio of 30:1, a ratio of 25:1, a ratio of 20:1, a ratio of 15:1, a ratio of 10:1, a ratio of 5:1, a ratio of 4:1, a ratio of 3:1, a ratio of 2:1, a ratio of 1:1, or any range between any of these values. In some embodiments, the ratio of application time to non-application time may be a ratio of 1:5. In other embodiments, the ratio of application time to non-application time may be a ratio of 1:6. In some embodiments, the ratio of application time to non-application time may be a ratio of 1:60.

These applications are for illustrative purposes only and are not intended as a limitation on the scope of the presently disclosed subject matter.

VI. Advantages of the Disclosed Composition

The presently disclosed subject matter provides a lubricant composition and system for lubricating a conveyor belt. A method of lubricating a conveyor belt when recycled water is present is also disclosed.

The disclosed lubricant composition exhibits anion tolerance when used with recycled water containing high levels of phosphates and/or sulfates. The disclosed lubricant composition can be diluted with recycled water and maintain water compatibility (low turbidity). Additionally, biocidal performance of the composition can be improved by blending with non-oxidizing biocides, such as, for example benzisothiazolinone and/or methylisothiazolinone. The lubricant composition also has good performance with coefficient of friction values less than 0.3.

Although several advantages of the disclosed system are set forth in detail herein, the list is by no means limiting. Particularly, one of ordinary skill in the art would recognize that there can be several advantages to the disclosed system and methods that are not included herein.

EXAMPLES

The following Examples provide illustrative embodiments. In light of the present disclosure and the general level of skill in the art, those of ordinary skill in the art will appreciate that the following Examples are intended to be exemplary only and that numerous changes, modifications, and alterations can be employed without departing from the scope of the presently disclosed subject matter.

Example 1

Lubricant Composition Comparison Testing of Water Compatibility and Phosphate Tolerance With amine-based lubricants, there is an unfavorable and unpredictable interaction between ions in the water. It is important to test the clear solubility of a lubricant over 5 days with the water quality when introducing a new lubricant to a lubrication system. A lubricant composition, sample 1, was prepared with the following composition seen in Table 1.

TABLE 1

| Lubricant Composition - Sample 1 | |
|---|---|
| Chemical | Weight % |
| Water | 90.85 |
| β-alanine, N-(2-carboxyethyl)N-tallow alkyl derivative | 4.95 |
| β-alanine, N-(2-carboxyethyl)N-(2-ethylhexyl) monosodium salt | 1.2 |
| N-lauroyl sarcosinic acid sodium salt | 1.5 |
| alcohol alkoxylate | 1.5 |

For some of the chemicals, the raw materials are in a diluted solution of water. The raw material of β-alanine, N-(2-carboxyethyl)N-tallow alkyl derivative was diluted in water and was 30% active. 16.5 wt % of the 30% active diluted solution of β-alanine, N-(2-carboxyethyl)N-tallow alkyl derivative was added, and resulted in a final weight percent in the final lubricant composition of 4.95 wt % β-alanine, N-(2-carboxyethyl)N-tallow alkyl derivative. Similarly, the raw material of β-alanine, N-(2-carboxyethyl) N-(2-ethylhexyl) monosodium salt was diluted in water and was 40% active. 3 wt % of the 40% active diluted solution of β-alanine, N-(2-carboxyethyl)N-(2-ethylhexyl) monosodium salt was added, and resulted in a final weight percent in the final lubricant composition of 1.2%. N-lauroyl sarcosinic acid sodium salt was diluted in water and was 30% active. 5 wt % of the 30% active solution of N-lauroyl sarcosinic acid sodium salt was added, and resulted in a final weight percent in the final lubricant composition of 1.5 wt % N-lauroyl sarcosinic acid sodium salt.

In order to simulate conditions similar to recycled water with high levels of anions, 2 ASTM water compositions were prepared with 2 different phosphate additions as shown in Table 2 (ASTM 2 has 50 ppm phosphate and ASTM 3 has 100 ppm phosphate).

TABLE 2

| Water Compositions | | |
|---|---|---|
| | Concentration (mg/L) | |
| Content | ASTM 2 | ASTM 3 |
| $Na_2SO_4$ | 295 | 295 |
| NaCl | 165 | 165 |
| $NaHCO_3$ | 138 | 138 |
| $CaCl_2 \times 2H_2O$ | 275 | 275 |
| $NaH_2PO_4 \times H_2O$ | 821.5 | 1643 |

Sample 1 was compared to reference samples: samples 2 and 3. Sample 2 is a dipropionate-based lubricant that does not contain sarcosinic acid sodium salt or alcohol alkoxylate and sample 3 is a standard diamine based lubricant.

The results for the lubricant composition, sample 1, as compared against a blank, sample 2 and sample 3 for the ASTM 2 water composition are shown in FIG. 1. As seen in FIG. 1, sample 2 starts precipitation in the presence of higher phosphate level (50 ppm) and has values of 4.66 FNU, 4.83 FNU, 5.18 FNU and 5.43 FNU for days 2, 3, 4, and 5, respectively. Sample 3 has increasing precipitation as the time increases with the highest turbidity value of 13.24 FNU on day 5. Sample 1 maintains turbidity levels less than 3, with the highest value of 2.96 FNU on day 5. Sample 1 has the lowest turbidity level on all days when compared against sample 2 and sample 3. Sample 1 shows a better tolerance against phosphate than sample 2 and sample 3.

Figure 2:
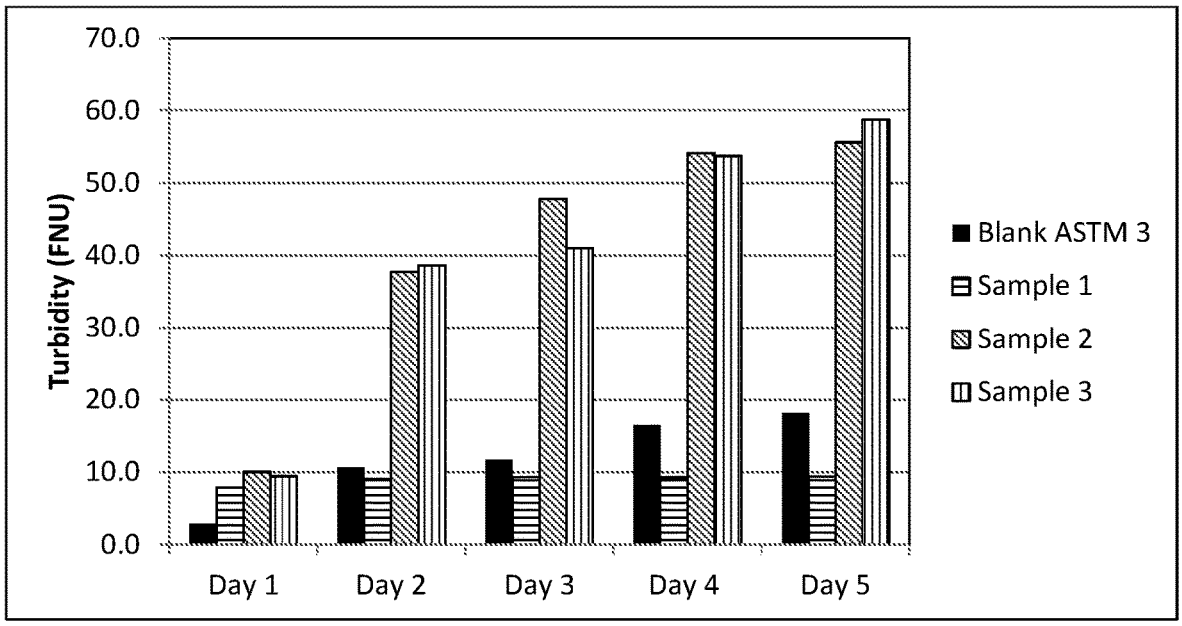
FIG. 2 is a bar graph that illustrates the turbidity values of lubricant compositions over a 5 day time period in ASTM 3 water.

The results for samples 1-3 are shown in FIG. 2 for the ASTM 3 water composition. A further increase of the phosphate level to 100 ppm resulted in significant precipitation of sample 2 and sample 3 (>10 FNU days 2-5). However, Sample 1 had turbidity levels of less than 10 FNU for all days, with the highest turbidity level of 9.43 FNU on day 5.

In conclusion, the lubricant composition of sample 1 had the lowest turbidity levels when compared to sample 2 and sample 3. Sample 1 had turbidity measurements less than the blank ASTM 2 sample as shown in FIG. 2. Sample 1 is the most water compatible with anions even when the quantity of phosphates is increased to 100 ppm phosphate. Overall, sample 1 had the highest water compatibility results out of all 3 samples and outperformed the blank ASTM 2 sample when testing at higher anion levels in the water.

Example 2

Figure 3:
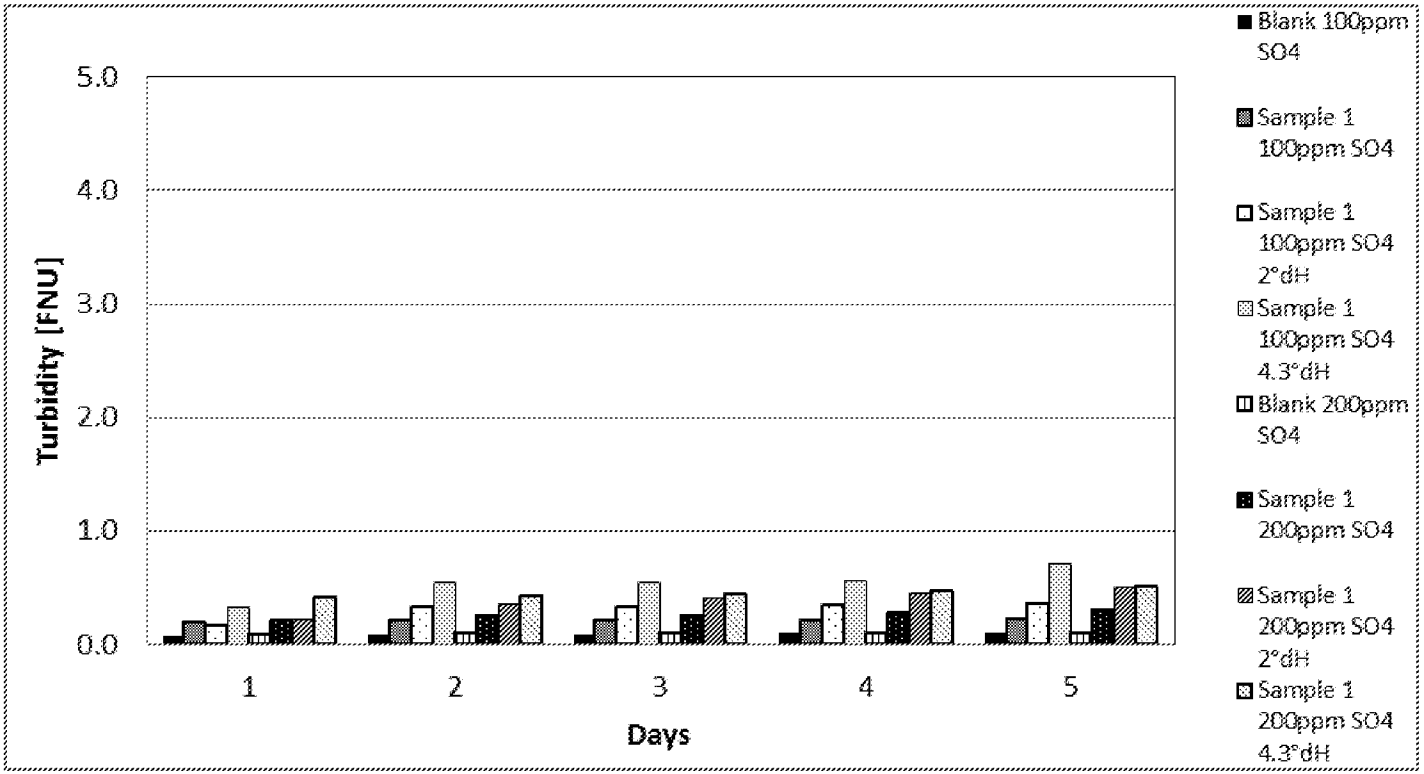
FIG. 3 is a bar graph that illustrates the turbidity values of an embodiment of a lubricant composition in various types of water over a 5 day time period.

Lubricant Composition Water Compatibility and Phosphate Tolerance Further Testing Sample 1 was tested for water compatibility and phosphate tolerance at varying degrees of water hardness and phosphate levels. Sample 1 was tested for turbidity measurements in deionized water with 100 ppm sulfate, 2° dH hard water with 100 ppm sulfate, 4.3° dH hard water with 100 ppm sulfate, deionized water with 200 ppm sulfate, 2° dH hard water with 200 ppm sulfate, and 4.3° dH hard water with 200 ppm sulfate. As shown in FIG. 3, sample 1 did show an increase in turbidity measurements as the water increased in degrees of hardness at both levels of sulfate, but the highest turbidity measurement of 0.42 FNU was significantly below the less than 10 FNU requirement for requirements for water tolerant.

In conclusion, sample 1 is water tolerant at varying degrees of water hardness and with high levels of anions and would be applicable for use in conveyor belts with recycled water containing high levels of anions.

Example 3

Comparison Performance Testing for Lubricant Compositions

Figure 4:
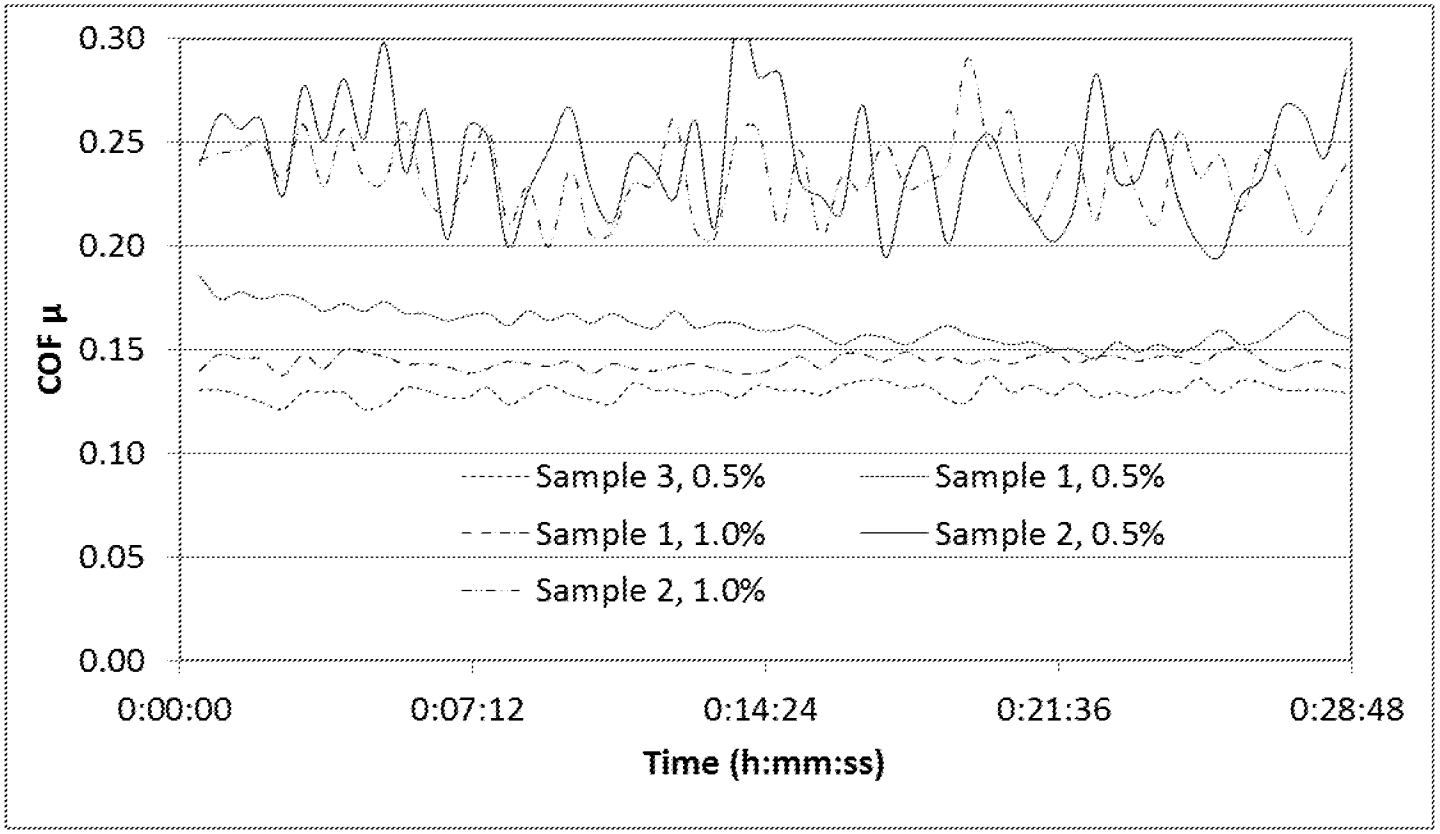
FIG. 4 is a line graph that illustrates coefficient of friction values over a 29 minute time period for various lubricant compositions.

Performance trials were done on a pilot conveyor for 3 different lubricant compositions (Samples 1-3 from Example 2) at 2 different concentrations (0.5% and 1.0%) for each sample. 8 aluminum beverage cans were tested on a stainless steel track against different dilutions of different lubricant compositions. The lubricant compositions were provided continuously with a spray nozzle of around 6 liters/hour volume flow. Sample 3 was used as a benchmark lubricant as it performs well in this environment. As shown in FIG. 4, the sample 1 composition at 0.5% showed acceptable performance with similar coefficient of friction (COF) amplitudes over time which indicates smooth beverage can transport. An increase of sample 1 concentration to 1% showed improved lubricant performance with a decrease in COF value at each time point when compared to the sample 1 0.5% concentration. Sample 2 at both concentrations resulted in much higher COF values and amplitudes at all time points when compared against sample 1 and sample 3.

In conclusion, sample 1 has a lubrication performance similar to sample 3, which was used as a benchmark in the performance testing. A 1.0% composition for sample 1 resulted in improved performance over the 0.5% concentration.

Example 4

Performance Trials with Beverage Spillage

A commonly known issue of synthetic lubricants used in soft drink conveyor lines centers around the reaction of acidic drinks and their ingredients like phosphoric acid with the amine, and the black soiling deposits, which are unsightly, can have a performance issue especially on can seamer transfer plates (brown staining).

Figure 5:
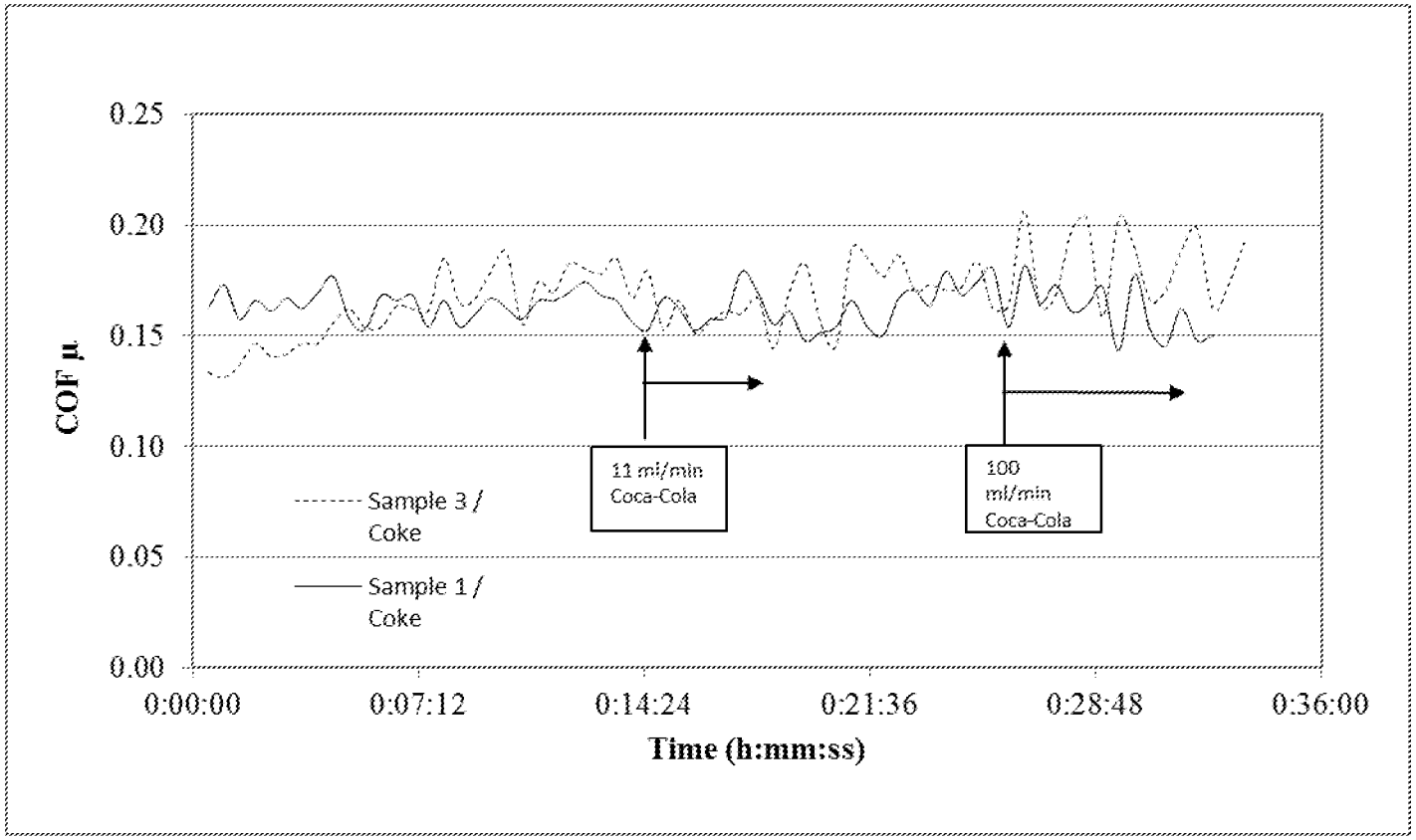
FIG. 5 is a line graph that illustrates coefficient of friction values over a 34 minute time period for various lubricant compositions when beverage spillage contacts the lubricant compositions.

Performance trials were performed in the presence of Coca-Cola spillage on aluminum beverage cans during conveyance on the pilot conveyor. The Coca-Cola spillage was provided by a peristaltic pump with a range of 0.1 to 500 ml/min. The Coca-Cola spillage was applied with a hose pipe at the lubricant spray nozzle dripping directly on the top of the conveyor track. Sample 1 and sample 3 lubricant compositions were compared in the presence of the Coca-Cola spillage. Each composition was started with 0.5% dilutions and after 15 minutes, Coca-Cola was added at a flow rate of 11 ml/min. At 25 minutes, the Coca-Cola spillage was applied at a rate of 100 ml/min. As seen in FIG. 5, both products showed comparable performance in the presence of Coca-Cola spillage levels of 11 ml/min. After the increase to 100 ml/min, the COF of sample 3 with an increase in amplitude, but sample 1 maintains a consistent COF with an amplitude lower than the COF of sample 3.

In conclusion, the sample 1 lubricant composition does not show an increase in COF when beverage spillage is introduced both at a low rate of 11 ml/min and a higher rate of 100 ml/min. The sample 1 lubricant composition outperforms the sample 3 lubricant composition at both rates of beverage spillage and would offer superior performance during lubrication of a beverage conveyor with beverage spillage.

Example 5

Comparison Testing Between Lubricant Compositions

Testing was completed to understand the effect of lubrication and water compatibility of sample 1 by replacing the amphoteric surfactant of the composition of sample 1 with various diamines. Comparison testing of two similar lubricant compositions (sample 4 and sample 5) was performed to determine if exchanging diamine quality would result in improved lubrication performance. The diamine, N-oley, 1,3-diaminopropane, was replaced with N-coco, 1,3-diaminopropane and the compositions are shown below in Table 2.

TABLE 2

Lubricant Composition of Samples 4 and 5

| Chemical | Weight % | |
|---|---|---|
| | Sample 4 | Sample 5 |
| Water | 93.74 | 93.74 |
| N-coco, 1,3-diaminopropane | — | 2.76 |
| N-oleyl, 1,3-diaminopropane | 2.76 | — |
| N-lauroyl sarcosinic acid sodium salt | 0.9 | 0.9 |

TABLE 2-continued

Lubricant Composition of Samples 4 and 5

| Chemical | Weight % | |
|---|---|---|
| | Sample 4 | Sample 5 |
| alcohol alkoxylate | 1 | 1 |
| acetic acid | 0.9 | 0.9 |
| tributoxyethyl phosphate | 0.7 | 0.7 |

Performance trials with returnable glass bottle (RGB) on a stainless steel track were done on a pilot conveyor to check for lubricity performance as determined by COF values. Lubricant dilutions at 0.6% in deionized water were tested under semi-dry conditions (lubricants dosed for 16 seconds which is equal to one turn of the conveyor track). The lubricant is dosed again when the COF increases. Each test was started up by a 2 minute dosing of lubricant dilution.

Figure 6:
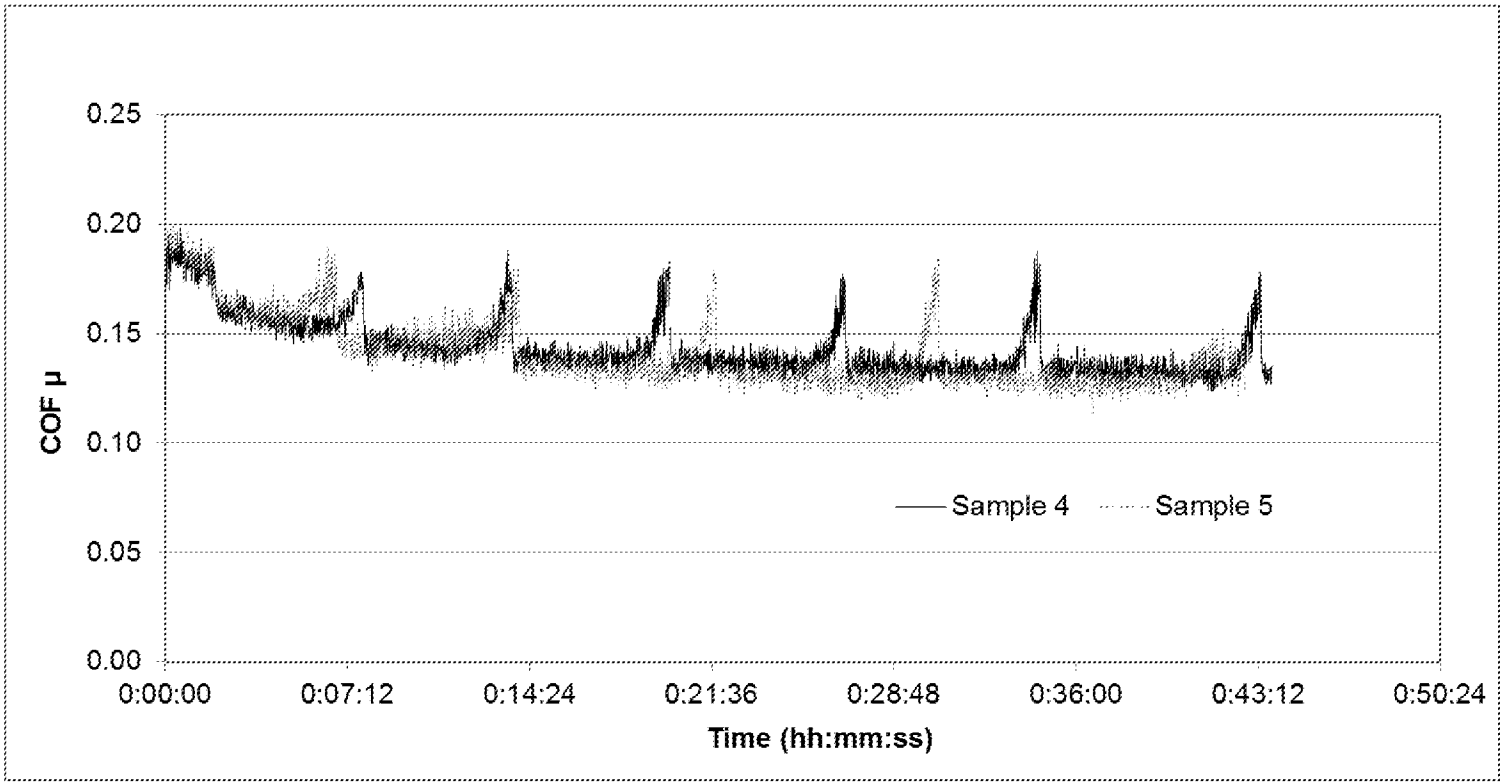
FIG. 6 is a line graph that illustrates coefficient of friction values over a 45 minute time period for 2 lubricant compositions with different diamine qualities.

As shown in FIG. 6, the performance of the lubricant is not negatively affected by the exchange of the diamine quality as both samples achieved a COF of about 0.13. However, sample 5 shows slightly extended off times (no lubricant dosing) compared to the original version (7-9 minutes instead of 6-8 minutes), resulting in sample 4 needing to be dosed more frequently than sample 5.

Example 6

Comparison Testing Between Lubricant Formulations for Water Compatibility

Two different lubricant formulations (sample 4 and sample 5 as discussed in Example 5) were further tested to determine if exchanging the diamine quality of N-oley, 1,3-diaminopropane with N-coco, 1,3-diaminopropane would offer better water compatibility. Each sample was tested at 3 different user concentrations (0.3%, 0.6%, 0.9%) with water having 5 different sulfate concentrations in deionized water (50 ppm, 75 ppm, 100 ppm, 150 ppm, 200 ppm) at 1 hour and 24 hour time points. The results are shown in Table 3 and Table 4 below.

TABLE 3

Results After 1 Hour

| Concentration of Sulfate | Turbidity with Sample 5 (FNU) User Concentrations | | | Turbidity with Sample 4 (FNU) User Concentrations | | |
|---|---|---|---|---|---|---|
| (ppm) | 0.30% | 0.60% | 0.90% | 0.30% | 0.60% | 0.90% |
| 50 | 2.98 | 4.52 | 6.44 | 9.91 | 20.1 | 8.36 |
| 75 | 3.5 | 3.9 | 3.63 | 18 | 22.2 | 21.5 |
| 100 | 2.95 | 2.59 | 4.01 | 23.9 | 39.5 | 41.9 |
| 150 | 2.86 | 3.24 | 4.34 | 38.9 | 42.5 | 65.5 |
| 200 | 3.07 | 4.71 | 8.6 | 49 | 100 | 150 |

TABLE 4

Results After 24 Hours

| Concentration of Sulfate | Turbidity with Sample 5 (FNU) User Concentrations | | | Turbidity with Sample 4 (FNU) User Concentrations | | |
|---|---|---|---|---|---|---|
| (ppm) | 0.30% | 0.60% | 0.90% | 0.30% | 0.60% | 0.90% |
| 50 | 3.1 | 6.28 | 8.49 | 16 | 31.4 | 10.7 |
| 75 | 4.03 | 4.77 | 6.2 | 39.1 | 56.6 | 60.4 |

TABLE 4-continued

| Results After 24 Hours | | | | | | |
|---|---|---|---|---|---|---|
| Concentration of Sulfate | Turbidity with Sample 5 (FNU) User Concentrations | | | Turbidity with Sample 4 (FNU) User Concentrations | | |
| (ppm) | 0.30% | 0.60% | 0.90% | 0.30% | 0.60% | 0.90% |
| 100 | 4.51 | 4.27 | 4.6 | 45.3 | 111 | 142 |
| 150 | 4.21 | 6.33 | 6.61 | 78.9 | 152 | 268 |
| 200 | 3.75 | 6.37 | 12.5 | 83.1 | 262 | 468 |

At both time points and each user concentration, sample 5 had significantly lower turbidity values at all concentrations of sulfate. At the 1 hour time point, the highest turbidity value was 8.6 FNU for Sample 5 at 0.9% and 200 ppm sulfate. Sample 4, however, had a turbidity value of 150 FNU at 0.9% and 200 ppm sulfate. At the 24 hour time point, sample 5 had a turbidity value of 12.5 FNU at 0.9% and 200 ppm. Sample 4, however, had a significantly higher turbidity value of 468 FNU at 0.9 and 200 ppm sulfate.

Another comparison test was performed to further analyze the water compatibility of both sample 5 and sample 4 with ASTM water containing 200 ppm sulfate. Both samples were evaluated at 1 hour and 24 hour time points at 3 different user concentrations (0.3%, 0.6%, 0.9%). The water composition is shown in Table 5 and the results are shown in Table 6.

TABLE 5

| ASTM Water Composition | |
|---|---|
| ASTM Water | Concentration (mg/L) |
| $Na_2SO_4$ | 295 |
| NaCl | 165 |
| $NaHCO_3$ | 138 |
| $CaCl_2 \times 2H_2O$ | 275 |

TABLE 6

| Results with ASTM Water Containing 200 ppm Sulfate | | | | |
|---|---|---|---|---|
| User | After 1 hr | | After 24 hrs | |
| Concentration | Sample 5 | Sample 4 | Sample 5 | Sample 4 |
| 0.30% | 1.94 | 7.77 | 2.9 | 8.43 |
| 0.60% | 2.55 | 8.39 | 3.76 | 13.1 |
| 0.90% | 2.89 | 13.6 | 3.61 | 13.9 |

The results show that ASTM water with 200 ppm sulfate produced lower values of turbidity for both samples. Overall, sample 5 had lower turbidity values than sample 4 at every time point for all user concentrations even after 24 hrs. This indicates sample 5 had better tolerance for anions.

Using the diamine quality with N-coco, 1,3-diaminopropane resulted in improved water compatibility with lower turbidity values over time at 0.3%, 0.6% and 0.9% user concentrations with ASTM water containing 200 ppm sulfate.

Example 7

Water Compatibility Testing for Lubricant Formulation

Figure 7:
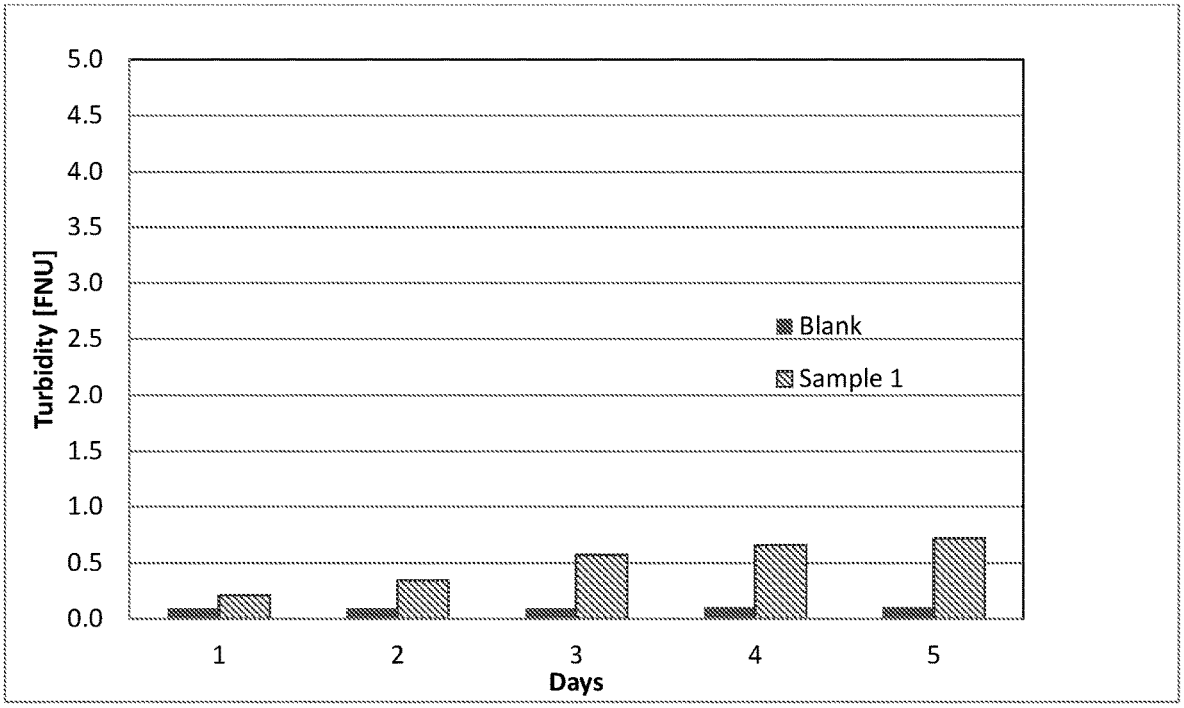
FIG. 7 is a bar graph that illustrates turbidity values for an embodiment of a lubricant composition over a 5 day time period tested with soft water containing high levels of anions.

The lubricant formulation of Sample 1, as discussed in Example 1, was further tested in a real world soft water (1.8 ppm $CaCO_3$ hardness) that also had high levels of anions (sulfates >200 ppm, and phosphates <1.5 ppm). The water and sample 1 were tested for turbidity levels over 5 days and results are shown in FIG. 7. Sample 1 was tested at a concentration of 0.6%. The blank had turbidity levels no higher than 0.1 FNU. Sample 1 had an initial turbidity level of 0.21 FNU and after 5 days had a turbidity level of 0.72.

In conclusion, sample 1 had very low turbidity levels that were all less than 1 FNU over the 5 day testing period. Sample 1 provides excellent water compatibility over a 5 day time period even with the presence of high levels of anions in the water.

Example 7

Water Compatibility Testing for Various Dipropionates

The water compatibility of different dipropionates (ß-Alanine-N-(2-carboxyethyl), N-Coco alkyl derivative (Dipropionate 1); ß-Alanine, N-(2-carboxyethyl)N-tallow alkyl derivate (Dipropionate 2); ß-Alanine, N-(2-carboxyethyl)N-(2-ethylhexyl) monosodium salt) (Dipropionate 3) were tested with four different water composition containing high level phosphates or high level sulfates (ASTM 1: water with 10 ppm phosphate, ASTM 2: water with 50 ppm phosphate, ASTM 3: water with 100 ppm phosphate, ASTM 4: water with 250 ppm sulfate, and ASTM 5: water with 500 ppm sulfate). The results are shown in Tables 7, 8, 9, 10 and 11.

TABLE 7

| Water Compatibility for Dipropionates in ASTM 1 Water | | | | | | |
|---|---|---|---|---|---|---|
| | Concen- | Turbidity in FNU | | | | |
| Product | tration | Day 1 | Day 2 | Day 3 | Day 4 | Day 5 |
| Blank ASTM 1 | | 0.06 | 0.06 | 0.07 | 0.07 | 0.07 |
| Dipropionate 1 | 0.5% | 0.32 | 0.82 | 20.00 | 20.60 | 22.10 |
| Dipropionate 2 | 0.5% | 0.19 | 46.30 | 71.30 | 74.20 | 77.20 |
| Dipropionate 3 | 0.5% | 0.08 | 0.08 | 0.10 | 0.11 | 0.11 |

TABLE 8

| Water Compatibility for Dipropionates in ASTM 2 Water | | | | | | |
|---|---|---|---|---|---|---|
| | Concen- | Turbidity in FNU | | | | |
| Product | tration | Day 1 | Day 2 | Day 3 | Day 4 | Day 5 |
| Blank ASTM 2 | | 0.07 | 0.07 | 0.08 | 0.08 | 0.08 |
| Dipropionate 1 | 0.5% | 0.80 | 1.23 | 24.00 | 26.80 | 38.70 |
| Dipropionate 2 | 0.5% | 0.19 | 91.70 | >100 | >100 | >100 |
| Dipropionate 3 | 0.5% | 0.10 | 0.13 | 0.12 | 0.11 | 0.13 |

TABLE 9

| Water Compatibility for Dipropionates in ASTM 3 Water | | | | | | |
|---|---|---|---|---|---|---|
| | Concen- | Turbidity in FNU | | | | |
| Product | tration | Day 1 | Day 2 | Day 3 | Day 4 | Day 5 |
| Blank ASTM 3 | | 0.09 | 0.12 | 0.16 | 0.24 | 0.29 |
| Dipropionate 1 | 0.5% | 1.03 | 18.19 | 28.00 | 32.40 | 37.10 |
| Dipropionate 2 | 0.5% | 1.00 | >100 | >100 | >100 | >100 |
| Dipropionate 3 | 0.5% | 0.49 | 0.61 | 0.59 | 0.60 | 0.61 |

TABLE 10

Water Compatibility for Dipropionates in ASTM 4 Water

| Product | Concentration | Turbidity in FNU Day 1 | Day 2 | Day 3 | Day 4 | Day 5 |
|---|---|---|---|---|---|---|
| Blank ASTM 4 | | 0.06 | 0.06 | 0.05 | 0.05 | 0.05 |
| Dipropionate 1 | 0.5% | 0.19 | 0.32 | 0.55 | 0.86 | 1.05 |
| Dipropionate 2 | 0.5% | 0.15 | 0.25 | 92.30 | >100 | >100 |
| Dipropionate 3 | 0.5% | 0.09 | 0.12 | 0.16 | 0.14 | 0.15 |

TABLE 11

Water Compatibility for Dipropionates in ASTM 5 Water

| Product | Concentration | Turbidity in FNU Day 1 | Day 2 | Day 3 | Day 4 | Day 5 |
|---|---|---|---|---|---|---|
| Blank ASTM 5 | | 0.07 | 0.07 | 0.07 | 0.07 | 0.07 |
| Dipropionate 1 | 0.5% | 0.25 | 0.33 | 0.41 | 0.88 | 1.21 |
| Dipropionate 2 | 0.5% | 0.47 | >100 | >100 | >100 | >100 |
| Dipropionate 3 | 0.5% | 0.08 | 0.12 | 0.16 | 0.20 | 0.23 |

The tested dipropionates had a different behavior in the presence of high levels of anions, like phosphates and sulfates. Dipropionate 2 was not compatible with the phosphates and sulfates, as at day 2, the dilutions with ASTM 1 (Table 7), ASTM 2 (Table 8), ASTM 3 (Table 9) and ASTM 5 (Table 11) were precipitating (>40 FNU) and with ASTM 4 (Table 10) the solution precipitated at day 3. Dipropionate 1 was compatible with high levels of sulfates as seen in Tables 10 and 11 (at day 5, turbidity <2 FNU) and not with high levels of phosphates as seen in Tables 7-8 (at day 3, turbidity >20 FNU) and seen in Table 9 (at day 2, turbidity >18 FNU). After 5 days, the turbidity of all dilutions with all of the different ASTM waters was below 1 FNU for Dipropionate 3. Thus, Dipropionate 3 showed the best results with excellent water compatibility for both tested anions. In conclusion, these results show that there is variation within the different raw materials, specifically dipropionates.

Example 8

Water Compatibility Testing for Various Non-Ionic Surfactants

Formulations containing different alcohol alkoxylate surfactants or no alcohol alkoxylate surfactants were tested for water compatibility at a user concentration of 0.5 wt %. The testing water was ASTM 3 (high levels of phosphate), the water composition is given in Table 2.

Figure 8:
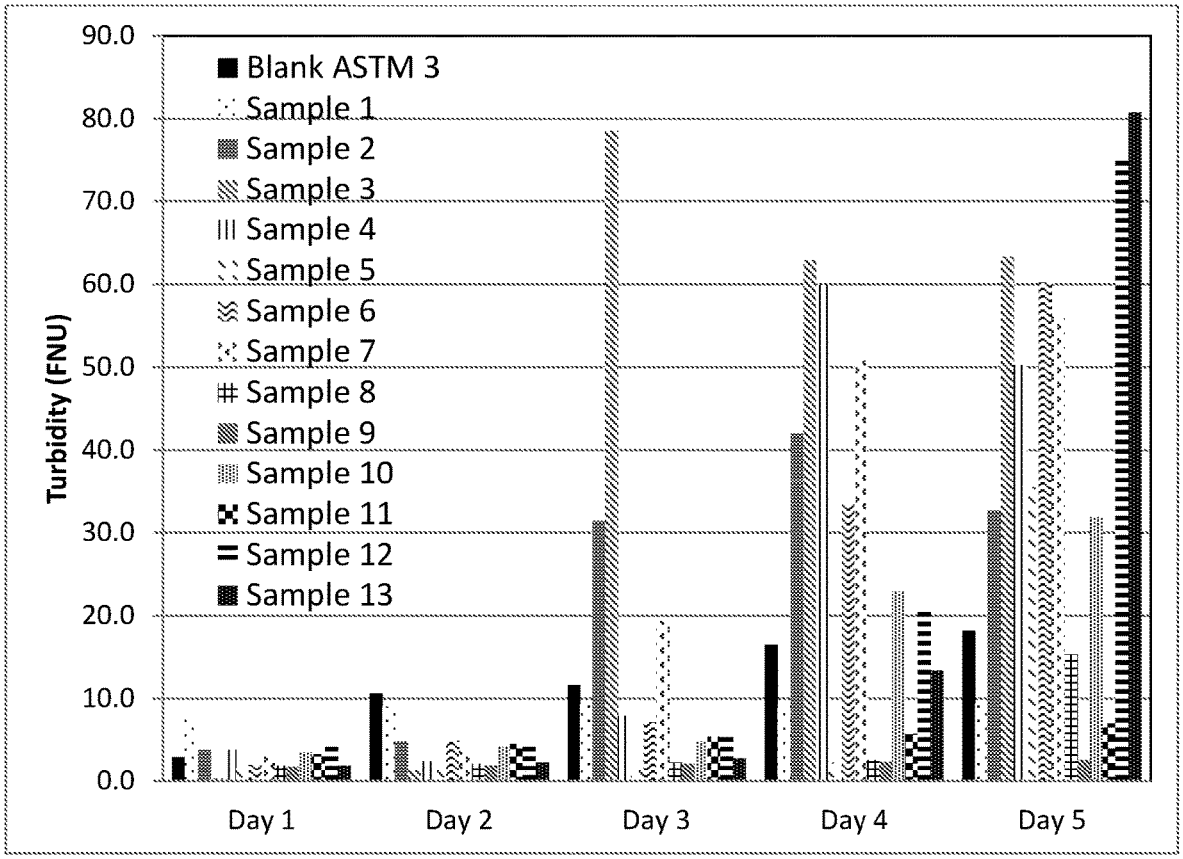
FIG. 8 is a bar graph that illustrates water compatibility testing for various non-ionic surfactants over a 5 day time period.

As shown in FIG. 8, sample 1, sample 9 and sample 11 show good water compatibility against high level of phosphates, as the turbidity values are <10 FNU after 5 days. Sample 4, sample 5, sample 6, sample 7, sample 8, sample 10, sample 12 and sample 13 are not compatible with high level of phosphates and show turbidity after 5 days (>10 FNU). Sample 3 does not containing any alcohol alkoxylate and was not compatible with high level of phosphates. Sample 3 showed that the alcohol alkoxylate in sample 1 had an influence on the water compatibility of the composition. Sample 2 contained the alcohol alkoxylate present in sample 1, but without Dipropionate 3 (II-Alanine, N-(2-carboxyethyl)N-(2-ethylhexyl) monosodium salt). Sample 2 showed turbidity after day 3. These samples show that the good water compatibility of the composition is a result of the mix of 2 dipropionates and of a selected alcohol alkoxylate.

The above mentioned examples of the invention demonstrate excellent tolerance against anions, particularly against phosphates and sulfates while having good lubrication performance. These results were further shown on challenging combinations like aluminum cans on stainless steel transfer plates under beverage spilling conditions.

It is further noticed that the excellent tolerance against anions does not depend on the presence of water hardness which is important for dilution with recycled water. Recycled water is softened water containing high levels of critical anions like phosphates or sulfates. The use of recycled water with the disclosed lubricant compositions does not have the risk of blocked distribution spray nozzles because there will be little to no precipitation formed by interaction of the disclosed lubricant compositions and critical anions.

Example 9

Lubricant Composition—Sample 14

A lubricant composition, sample 14, was prepared with the following composition seen in Table 12.

TABLE 12

Lubricant Composition for Sample 14

| Chemical | Weight % |
|---|---|
| Water | 89.62 |
| N-coco, 1,3-diaminopropane | 4.6 |
| Acetic acid | 1.98 |
| Tributoxyethyl phosphate | 1.0 |
| Cocamidopropyl betaine | 1.8 |
| Alkyl (C8) amino dipropionate mono Na-salt | 1.0 |

For some of the chemicals, the raw materials were in a diluted solution of water. The raw material of N-coco, 1,3-diaminopropane was diluted in water and was 92% active. 5.0 wt % of the 92% active diluted solution of N-coco, 1,3-diaminopropane was added and resulted in a final weight percent in the final lubricant composition of 4.6 wt % N-coco, 1,3-diaminopropane. Similarly, the raw material of acetic acid was diluted in water and was 60% active. 3.2 wt % of the 60% active diluted solution of acetic acid was added, and resulted in a final weight percent in the final lubricant composition of 1.98%. Tributoxyethyl phosphate was not diluted in water and was 100% active. The final lubricant composition had 1.0 wt % of the 100% active solution of tributoxyethyl phosphate. Cocamidopropyl betaine was diluted in water and was 30% active. 6.0 wt % of the 30% active solution of cocamidopropyl betaine was added, and resulted in a final weight percent in the final lubricant composition of 1.8 wt % cocamidopropyl betaine. Alkyl (C8) amino dipropionate mono Na-salt was diluted in water and was 40% active. 2.5 wt % of the 40% active solution of alkyl (C8) amino dipropionate mono Na-salt was added, and resulted in a final weight percent in the final lubricant composition of 1.0 wt % alkyl (C8) amino dipropionate mono Na-salt.

Figure 9:
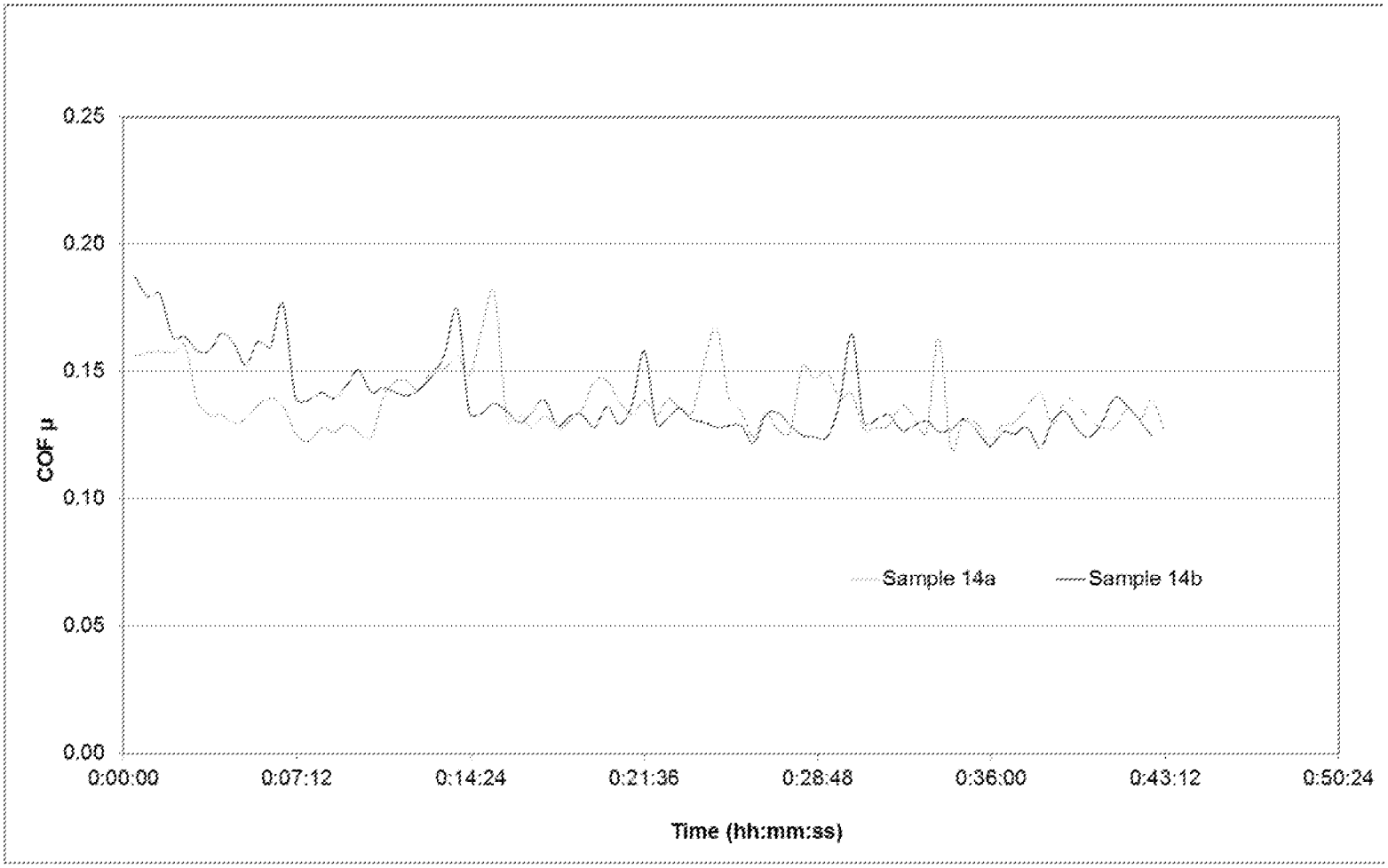
FIG. 9 is a line graph that illustrates coefficient of friction values over a 45 minute time period for 2 lubricant compositions with the same formulation, but different raw material sources.

Sample 14 was prepared to try and meet the demands of non-optimal production lines that required a higher lubricant concentration of previous lubricants. The new formulation of sample 14 would allow for the same lubrication performance at the low lubricant concentration (0.6%) on these non-optimal production lines without the need to increase the lubricant concentration. Performance trials with returnable glass bottle (RGB) on a stainless steel track were done on a pilot conveyor to check for lubricity performance as determined by COF values. Lubricant dilutions at 0.6% in deionized water were tested under semi-dry conditions (lubricants dosed for 16 seconds which is equal to one turn of the conveyor track). The lubricant was dosed again when the COF increased. Each test was started up by a 2 minute dosing of lubricant dilution. FIG. 9 shows the COF values over a 45 minute time interval for samples 14a and 14b. These samples were the same formulation as Sample 14, but have raw materials that were purchased in two different countries. Samples 14a and 14b were tested separately to show that the same formulation, but different raw material sources, do not result in any statistically different COF values.

As shown in FIG. 9, samples 14a and 14b achieved a COF of about 0.13 and had off times (no lubricant dosing) of 8-9 minutes. In conclusion, Sample 14 at 0.6% concentration, performs with a low COF and with a slightly extended off time as compared to previous lubricants on production lines that had required previous lubricants at 1.0% to 1.2% concentration.

Example 10

Performance Testing for Sample 14

A performance trial for sample 14 was done at a bottling facility that used recycled water combined with soft water to dilute conveyor lubricants. The water had a pH of 7.50-8.90 and had sulfates present. Sample 14 was tested at 0.50% to 0.55% lubricant concentration for a 6-day period on a returnable glass bottle line that was divided into 10 zones with fan jet nozzles. There were a total of 225 nozzles on the line with a nozzle on-time percent of 40%. The bottles used on the conveyor belt were 200 ml and 300 ml bottles of carbonated soft drinks.

Figure 10:
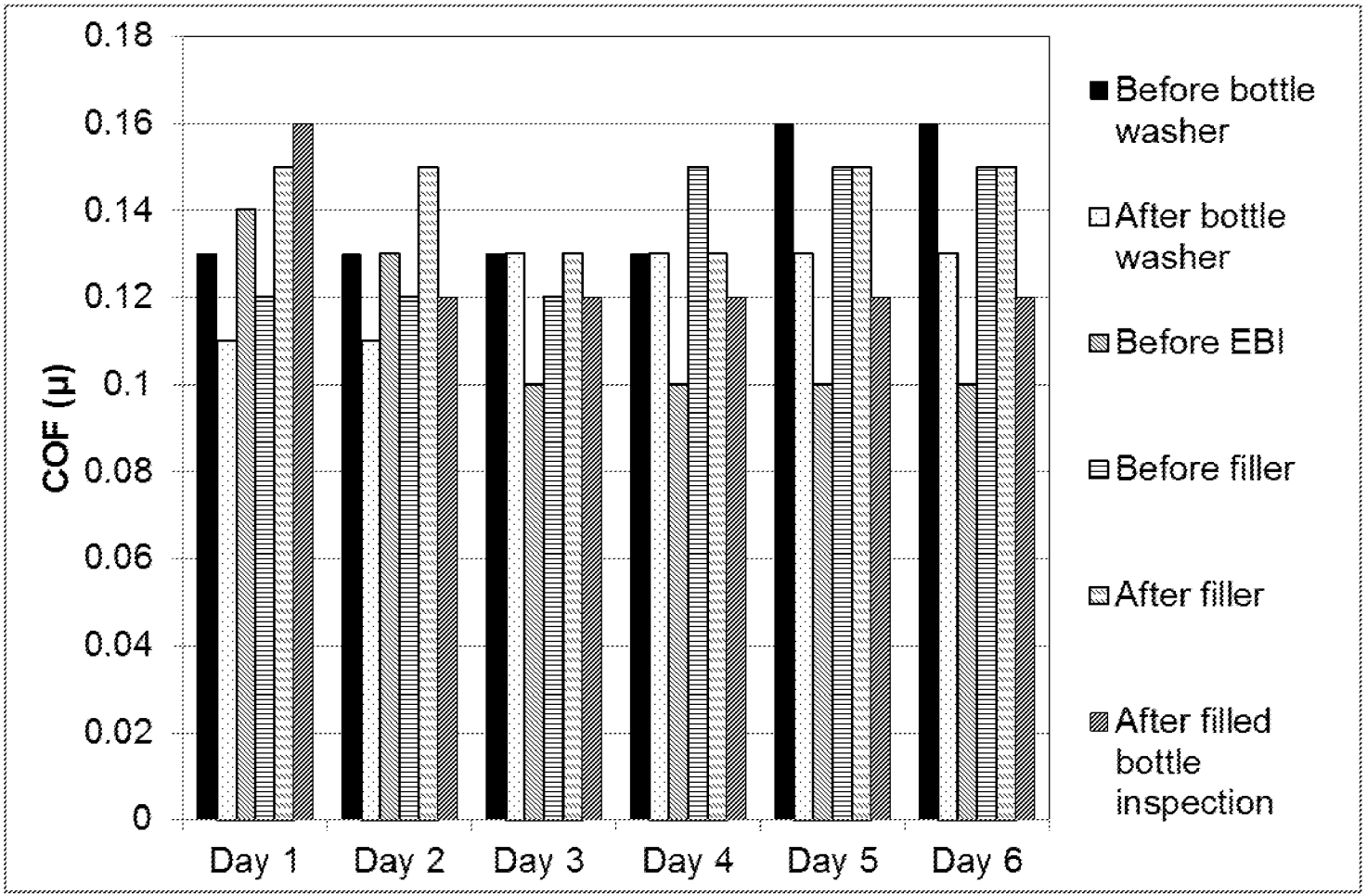
FIG. 10 is a bar graph that illustrates the coefficient of friction of a lubricant composition at 6 different locations on a conveyor belt.

FIG. 10 shows the COF values at 6 different locations on the conveyor belt. Sample 14 maintained COF values of 0.10 to 0.16 across all locations on the conveyor. Sample 14 provided lubrication between returnable glass bottles and steel conveyor belts at minimum use concentrations of 0.55% at 40% nozzle on-time. Stable foam was not observed across the line, no nozzle clogging was observed and no slime deposit was observed during the trial. In conclusion, the low COF maintained at varying locations on the conveyor belt shows a satisfactory performance for sample 14.

Example 11

Performance Testing for Samples 15 and 16

A lubricant composition, sample 15, was prepared with the following composition seen in Table 13.

TABLE 13

Lubricant Composition for Sample 15

| Chemical | Sample 15 (wt %) | Sample 16 (wt %) |
|---|---|---|
| Water (soft) | 86.2 | 87.7 |
| Acetic Acid | 2.7 | 2.7 |
| N-oleyl-1,3-diaminopropane | 4.6 | 4.6 |
| Alcohol (C13) Ethoxylate (12-13 EO) | 4.0 | 4.0 |

TABLE 13-continued

Lubricant Composition for Sample 15

| Chemical | Sample 15 (wt %) | Sample 16 (wt %) |
|---|---|---|
| Tributoxyethyl phosphate | 1.0 | 1.0 |
| N,N-bis(3-aminopropyl)dodecylamine | 1.5 | — |

For some of the chemicals, the raw materials were in a diluted solution of water. The raw material of N-oleyl-1,3-diaminopropane was diluted in water and was 92% active. 5.0 wt % of the 92% active diluted solution of N-oleyl-1,3-diaminopropane was added and resulted in a final weight percent in the final lubricant composition of 4.6 wt % N-oleyl-1,3-diaminopropane. Similarly, the raw material of acetic acid was diluted in water and was 60% active. 4.5 wt % of the 60% active diluted solution of acetic acid was added, and resulted in a final weight percent in the final lubricant composition of 2.7%. Tributoxyethyl phosphate was not diluted in water and was 100% active. The final lubricant composition had 1.0 wt % of the 100% active solution of tributoxyethyl phosphate. N,N-bis(3-aminopropyl)dodecylamine was diluted in water and was 30% active. 5.0 wt % of the 30% active solution of N,N-bis(3-aminopropyl)dodecylamine was added, and resulted in a final weight percent in the final lubricant composition of 1.5 wt % N,N-bis(3-aminopropyl)dodecylamine.

Figure 11:
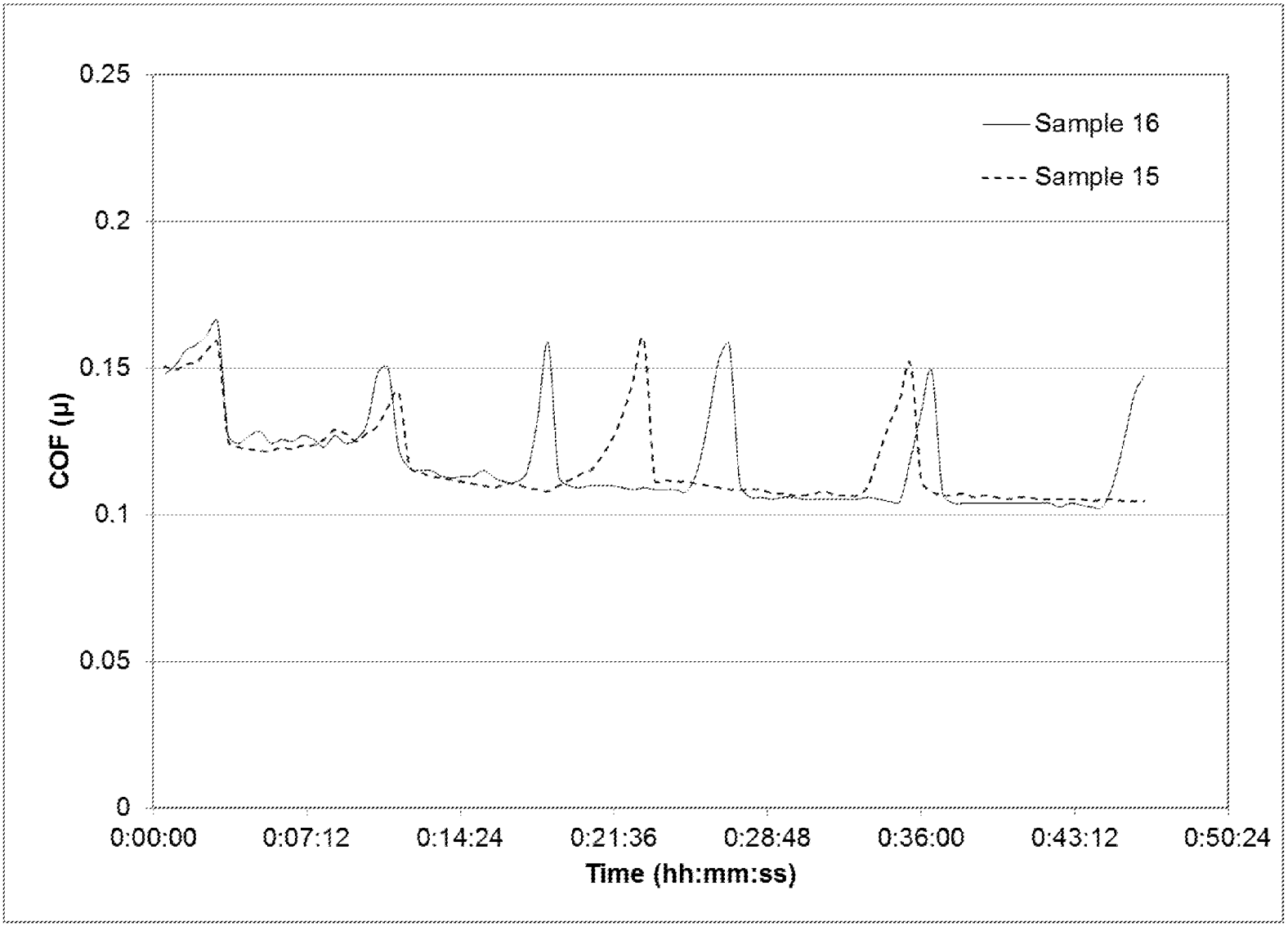
FIG. 11 is a line graph that illustrates coefficient of friction values over a 47 minute time period for 2 lubricant compositions with the same formulation, but one contains a biocide and the other does not.

Performance trials with returnable glass bottle (RGB) on a stainless steel track were done on a pilot conveyor to check for lubricity performance as determined by COF values. Lubricant dilutions at 0.6% in deionized water were tested under semi-dry conditions (lubricants dosed for 16 seconds which is equal to one turn of the conveyor track). The lubricant was dosed again when the COF increased. Each test was started up by a 2 minute dosing of lubricant dilution. FIG. 11 shows the COF values over a 47 minute time interval for samples 15 and 16. These samples had the same formulations, but sample 15 had the addition of a biocide, N,N-bis(3-aminopropyl)dodecylamine. Samples 15 and 16 were tested separately to show the effects of the addition of a biocide.

As shown in FIG. 11, sample 15 achieved a COF of 0.105 and had off times (no lubricant dosing) of 12.5 minutes. Sample 16 achieved a COF of 0.147 and had off times (no lubricant dosing) of 9 minutes. The addition of a biocide, specifically, N,N-bis(3-aminopropyl)dodecylamine, results in an increase of lubrication as can be seen by the increase of the off time during the performance trial. The increase of the off time indicates that the formulation of sample 15 is lubricating the track for a longer period of time, and results in less frequent on time which is lubricant dosing during the performance trial.

In conclusion, sample 15 at 0.6% concentration, performs with a lower COF and with a slightly extended off time as compared to sample 16. It is shown that the alkylamine (biocide) plays a role in the extension of the off times during the lubrication testing.

Example 12

Water Compatibility Testing for Various Non-Ionic Surfactants

Formulations containing different alcohol ethoxylate surfactants were tested for water compatibility at a user concentration of 0.6 wt %. Recycled water is softened water containing high levels of critical anions like phosphates or sulfates, which does not have the risk of blocked distribution spray nozzles due to little or no precipitation formed by interaction of the disclosed lubricant compositions and critical anions. There were 2 types of recycled water tested: soft water with 200 ppm sulfate (high levels of sulfate), ASTM 1 (low levels of phosphate) and ASTM. Water was considered to be compatible with the anion when the turbidity value was at or below 10 FNU. The water compositions are given in Table 14.

TABLE 14

| Water Formulations | | |
|---|---|---|
| Chemicals | ASTM 1 (10 ppm $PO_4^{3-}$) (L) | Soft Water + 200 ppm sulfate (L) |
| $Na_2SO_4$ | 0.590 | 0.590 |
| NaCl | 0.330 | — |
| $NaHCO_3$ | 0.276 | — |
| $CaCl_2 \times 2H_2O$ | 0.550 | — |
| $NaH_2PO_4 \times 2H_2O$ | 0.0328 | — |
| Osmose $H_2O$ | 1998.22 | — |
| Soft $H_2O$ | — | 1999.41 |

Figure 12:
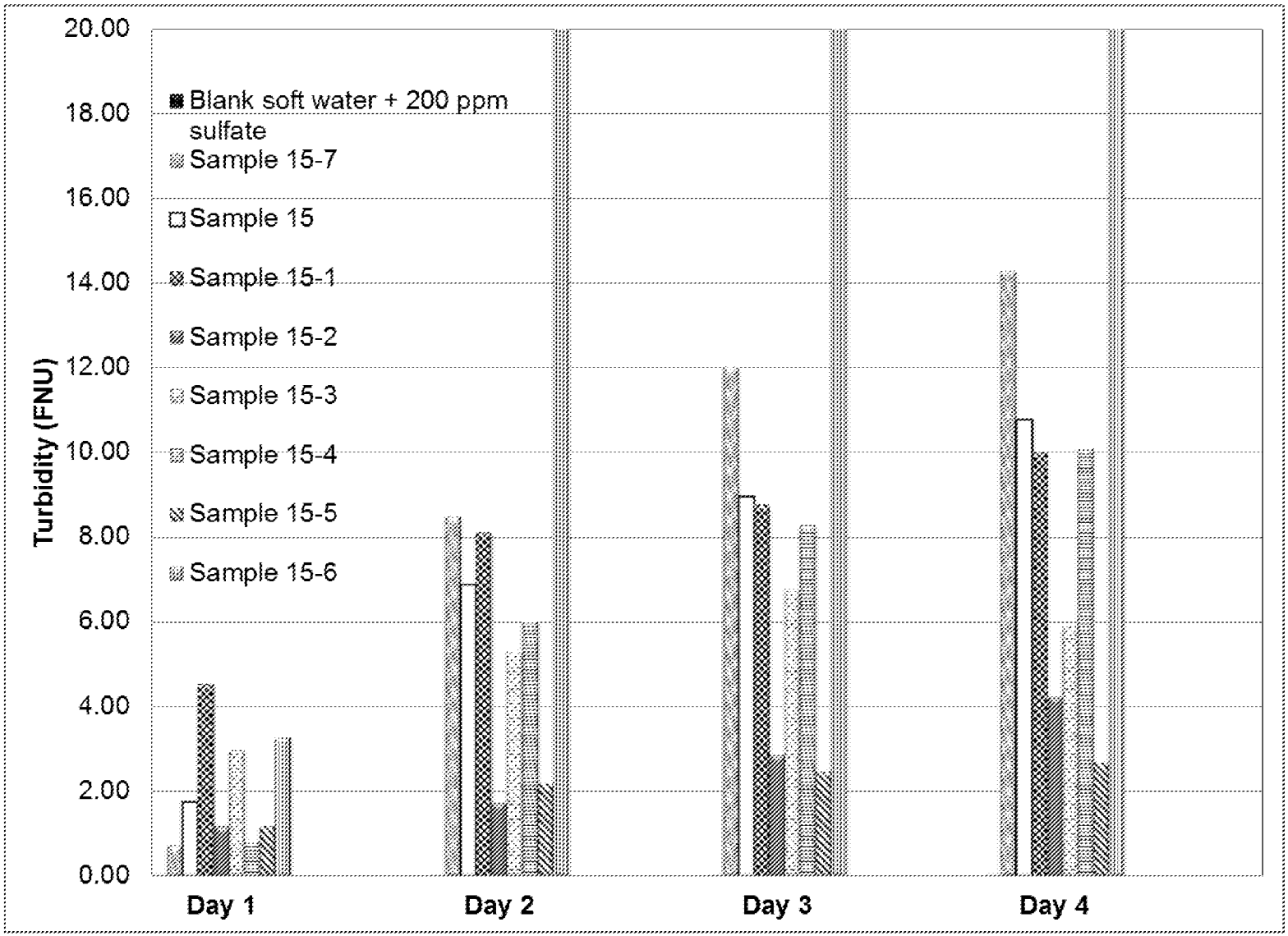
FIG. 12 is a bar graph that illustrates water compatibility testing for lubricant formulations containing biocide and various non-ionic surfactants over a 4 day time period with water with high sulfates.

As shown in FIG. 12, Sample 15-2, sample 15-3, sample 15-5 had very good water compatibility with soft water containing 200 ppm sulfate, as the turbidity values were <10 FNU after 4 days. Samples 15-2, 15-3 and 15-5, respectively, had values of 4.23 FNU, 5.88 FNU and 2.68 FNU. Sample 15, sample 15-1 and sample 15-4 had acceptable water compatibility against high levels of sulfate in soft water as the turbidity values were around 10 FNU. Samples 15, 15-1 and 15-4, respectively, had values of 10.78 FNU, 10.02 FNU and 10.10 FNU. Sample 15-6 was not compatible with soft water containing 200 ppm sulfate because it had a turbidity of 145.40 FNU (>10 FNU) after 4 days.

All the tested formulations contain an alcohol ethoxylate but the degree of ethoxylation and/or the carbon chain length is different. FIG. 12 shows that both the degree of ethoxylation and the carbon chain length have an influence on the water compatibility. Sample 15-2, sample 15-3 and sample 15-5 had a low ethoxylation level (3EO and 7EO) and had the best compatibility with turbidity values below 10 FNU. Sample 15, sample 15-1 and sample 15-4 had acceptable results (turbidity values around 10 FNU) and indicates after a certain level of ethoxylation (8EO or higher) there was no big influence on the water compatibility. Sample 15-6 had the worst result, the nonionic surfactant had 3EO and a short carbon length (C10) rather than the other nonionic surfactant which had a longer carbon length (C12/C13 or C13).

Figure 13:
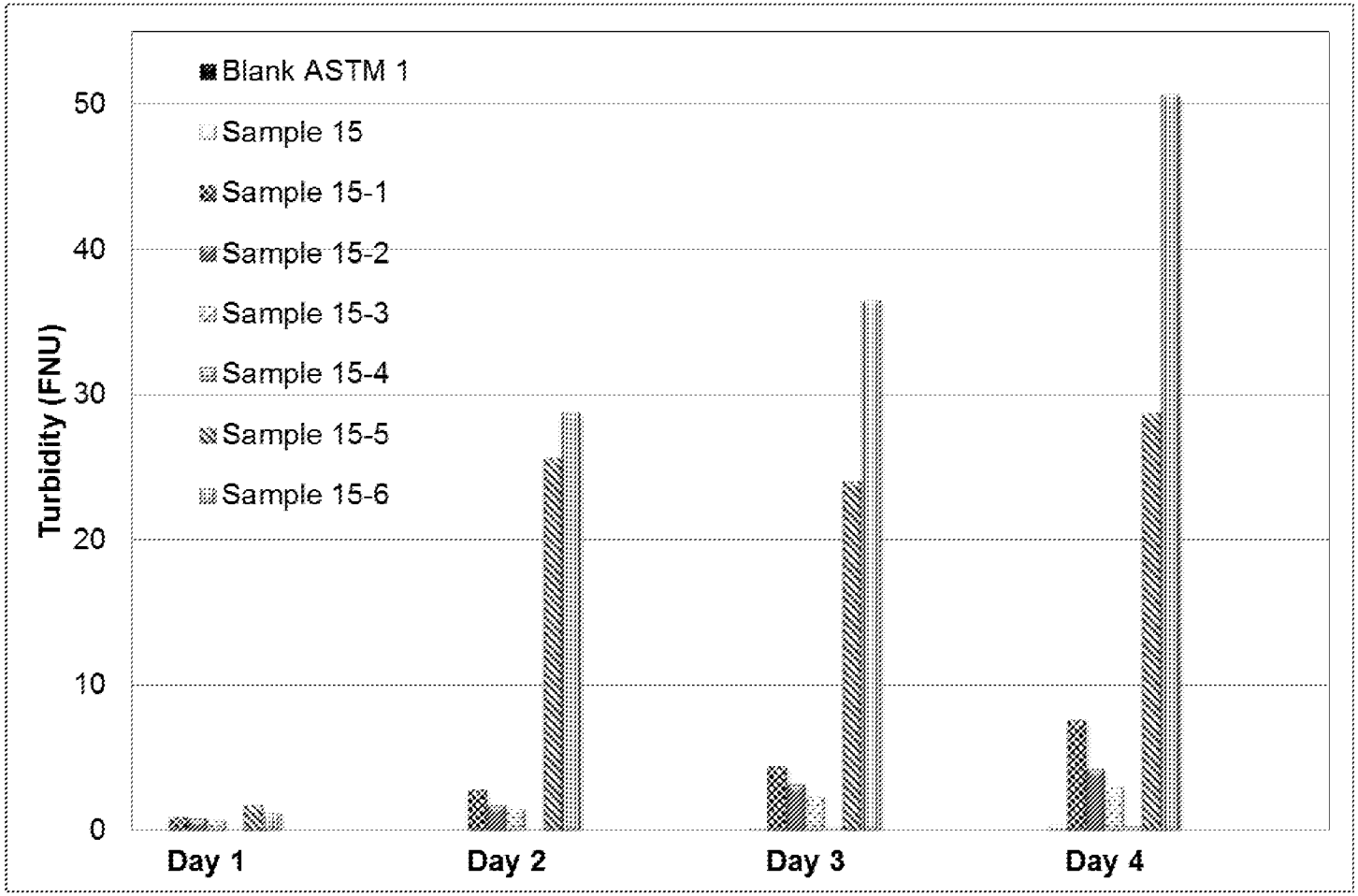
FIG. 13 is a bar graph that illustrates water compatibility testing for lubricant formulations containing biocide and various non-ionic surfactants over a 4 day time period with water with high phosphates.

As seen in FIG. 13, Sample 15, sample 15-1, sample 15-2, sample 15-3, sample 15-4 had very good or good water compatibility against ASTM 1 water containing 10 ppm of phosphate as the turbidity values were <10 FNU after 4 days. Samples 15, 15-1, 15-2, 15-3 and 15-4, respectively, had values of 0.37 FNU, 7.58 FNU, 4.18 FNU, 2.92 FNU, and 0.30 FNU. Sample 15-5 and sample 15-6 were not compatible with ASTM 1 water (with 10 ppm phosphate) as the turbidity values were >10 FNU after 5 days. Samples 15-5 and 15-6, respectively, had values of 28.70 FNU and 50.70 FNU.

All the tested formulations contained an alcohol ethoxylate but the degree of ethoxylation and/or the carbon chain length was different. FIG. 13 shows that the carbon chain length had a stronger influence on the water compatibility compared to the degree of ethoxylation. Sample 15-5 and Sample 15-6 had the short carbon chain length (C12/13 for Sample 15-5 and C10 for Sample 15-6) and indicated that the best water compatibility with ASTM 1 water (with 10 ppm of phosphate) was achieved when the lubricant was formulated with a nonionic surfactant with a C13 carbon chain length.

Example 13

Water Compatibility Testing for Various Non-Ionic Surfactants

Formulations without biocide containing different alcohol ethoxylate surfactants were tested for water compatibility at a user concentration of 0.6 wt %. The recycled water tested was ASTM 1 (low levels of phosphate) and soft water with 200 ppm sulfate (high levels of sulfate), the water compositions were given in Table 14 above.

Figure 14:
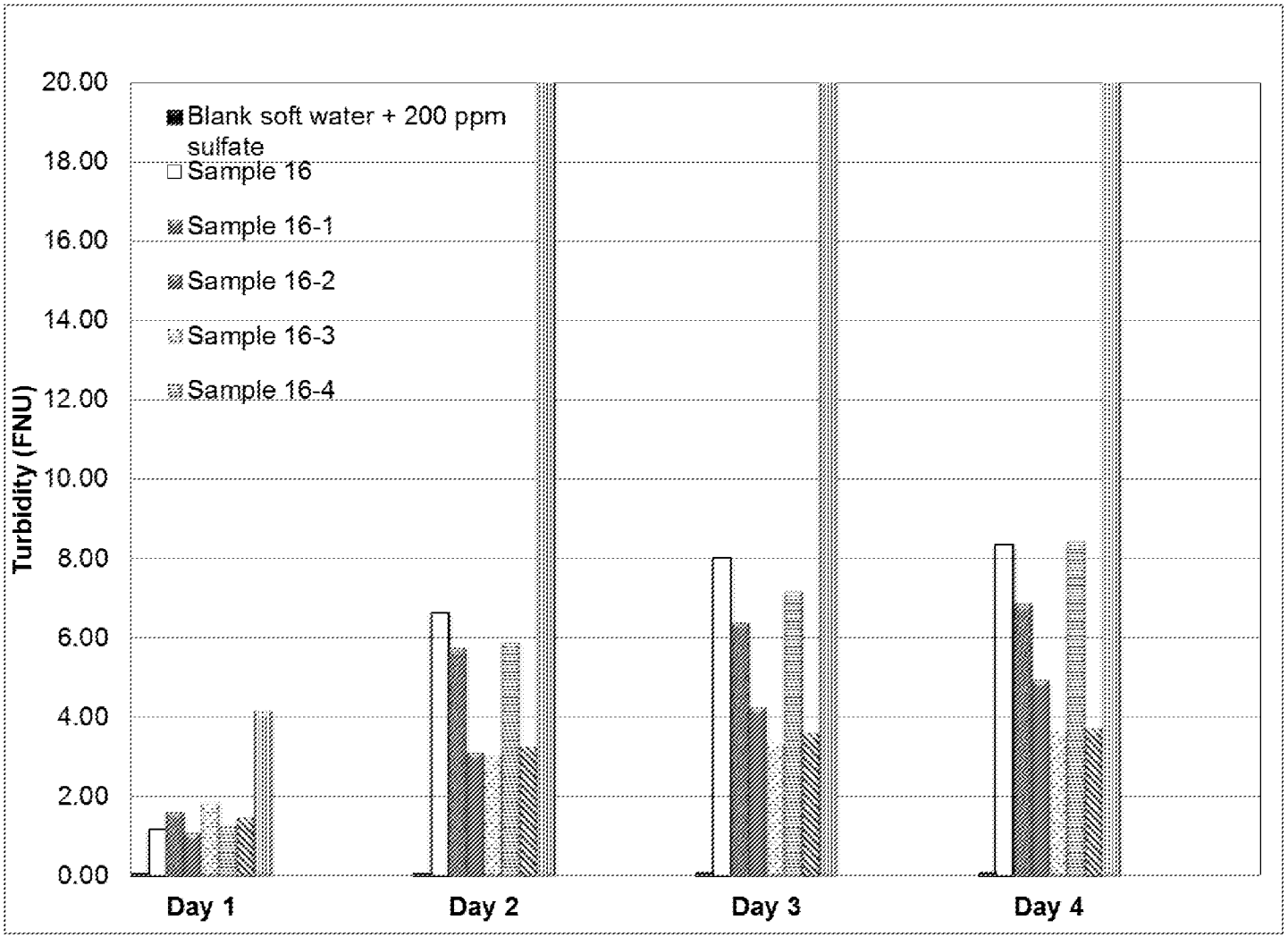
FIG. 14 is a bar graph that illustrates water compatibility testing for lubricant formulations with no biocide and containing various non-ionic surfactants over a 4 day time period with water with high sulfates.

As seen in FIG. 14, sample 16, sample 16-1, sample 16-2, sample 16-3, sample 16-4 and sample 16-5 had very good water compatibility against high levels of sulfate in soft water, as the turbidity values were <10 FNU after 4 days. Samples 16, 16-1, 16-2, 16-3, 16-4 and 16-5, respectively, had values of 8.36 FNU, 6.88 FNU, 4.95 FNU, 3.66 FNU, 8.46 FNU and 3.72 FNU. Only sample 16-6 was not compatible with soft water with 200 ppm sulfate, as the sample had a turbidity value of 148.95 FNU after 4 days.

It is noticeable that the level of ethoxylation and the carbon chain length of the nonionic surfactant played a role in the water compatibility. Sample 16-2, sample 16-3 and sample 16-5 had low ethoxylation levels (3EO and 7EO) and had the best water compatibility with turbidity values less than 4. Sample 16, sample 16-1, sample 16-4 had turbidity values below 10 and all samples had an ethoxylation level of 8EO or higher. Sample 16-6 had the worst water compatibility (148.95 FNU), with a nonionic surfactant that had 3EO and a short carbon length (C10) rather than the other nonionic surfactant which had a longer carbon length (C12/C13 or C13).

Sample 16, sample 16-1 and sample 16-3 had lower turbidity values, respectively, 8.36 FNU, 6.88 FNU and 3.66 FNU (FIG. 14) than sample 15, sample 15-1 and sample 15-3, respectively 10.78 FNU, 10.02 FNU and 5.88 FNU (FIG. 12). These results indicate that the addition of the biocide increases the turbidity and decreases the water compatibility in soft water with 200 ppm sulfate when the lubricant is formulated with a nonionic surfactant with an ethoxylation level higher or equal to 7EO. Sample 16-2, sample 16-5 and sample 16-6 (FIG. 14) have similar turbidity values range, respectively, 4.95 FNU, 3.72 FNU and 148.95 FNU, than sample 15-2, sample 15-5 and sample 15-6 (FIG. 12), respectively, 4.23 FNU, 2.68 FNU and 145.40 FNU. These results indicate that with a low ethoxylation level (3EO), the addition of the biocide (alkylamine) did not play a significant role in the water compatibility in soft water with 200 ppm sulfate whether the lubricant was compatible or not with the water quality.

Figure 15:
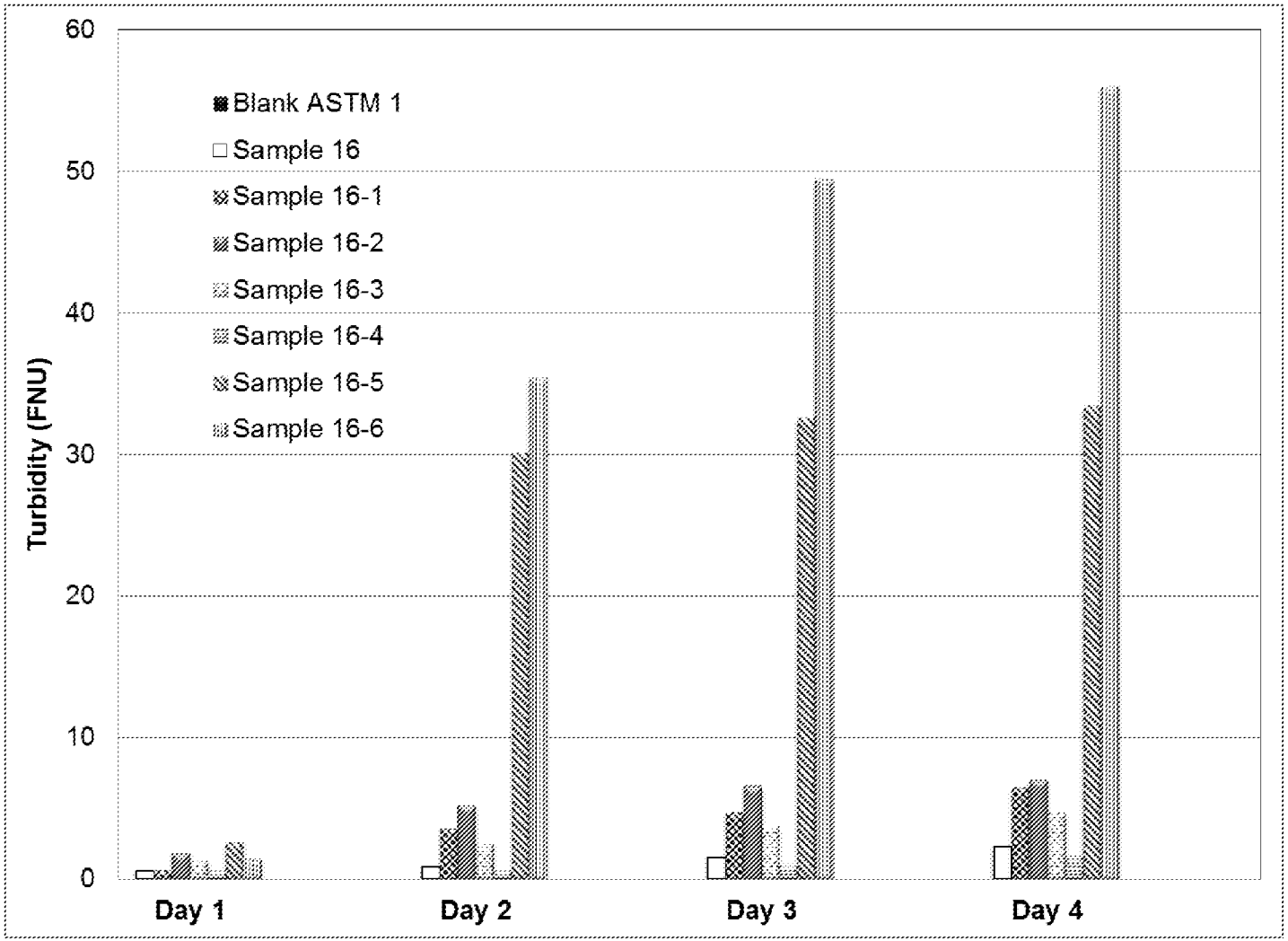
FIG. 15 is a bar graph that illustrates water compatibility testing for lubricant formulations with no biocide and containing various non-ionic surfactants over a 4 day time period with water with high phosphates.

As seen in FIG. 15, sample 16, sample 16-1, sample 16-2, sample 16-3 and sample 16-4 show very good or good water compatibility against ASTM 1 water (low level of phosphate) as the turbidity values were <10 FNU after 4 days. Samples 16, 16-1, 16-2, 16-3 and 16-4 had turbidity values of 2.30 FNU, 6.47 FNU, 7.00 FNU, 4.68 FNU and 1.64 FNU, respectively. Sample 16-5 and sample 16-6 were not compatible with ASTM 1 water (low level of phosphate) as the turbidity values were >10 FNU after 5 days. Sample 16-5 and sample 16-6 had turbidity values of 33.40 FNU and 56.00 FNU, respectively.

All the tested formulations contained an alcohol ethoxylate but the degree of ethoxylation and/or the carbon chain length was different. FIG. 16 shows that the carbon chain length has a stronger influence on the water compatibility compared to the degree of ethoxylation. Sample 16-5 and sample 16-6 had the short carbon chain length (C12/13 for sample 16-5 and C10 for sample 16-6), which indicated that the best water compatibility with ASTM 1 water (low level of phosphate) was achieved when the lubricant was formulated with a nonionic surfactant with a C13 carbon chain length Sample 16, sample 16-1, sample 16-2, sample 16-3, sample 16-4, sample 16-5 and sample 16-6 shows similar or slightly worse turbidity values than sample 15, sample 15-1, sample 15-2, sample 15-3, sample 15-4, sample 15-5 and sample 15-6, respectively. In conclusion, these results indicate that the addition of biocide (alkylamine) does not play a significant role on the compatibility of the lubricant with ASTM water with 10 ppm phosphate.

In conclusion, the formulations in examples 12 and 13 demonstrated excellent tolerance against anions, particularly against phosphates and sulfates. Sample 15 had a turbidity of 10.78 FNU at Day 4 and sample 16 had a turbidity of 8.36 FNU at Day 4 with high levels of sulfate in soft water. The lower turbidity value of sample 16 meant it was more compatible with recycled water with anions. Both sample 15 and sample 16 had good water compatibility, but sample 16 had increased water compatibility.

What is claimed is:

1. A lubricant composition comprising:

65 wt % to 95 wt % water;

1 wt % to 25 wt % of at least one amphoteric surfactant, wherein the at least one amphoteric surfactant is β-alanine, N-(2-carboxyethyl)N-(2-ethylhexyl) monosodium salt;

1 wt % to 10 wt % of at least one anionic surfactant; and 0.5 wt % to 10 wt % of at least one non-ionic surfactant.

2. The composition as in claim 1, further comprising β-alanine, N-(2-carboxyethyl)N-tallow alkyl derivative as a second amphoteric surfactant.

3. The composition as in claim 1, wherein the at least one anionic surfactant comprises at least one member selected from the group consisting of N-acyl-sarcosinates, alkylethercarboxylates, alkane sulphonates, alkyl sulfates, alkyl sulphonates, alkyl ether sulfates, branched alkyl benzene sulphonates, linear alkyl benzene sulphonates and their salts.

4. The composition of claim 3, wherein the N-acyl-sarcosinate is N-lauroyl sarcosinic acid sodium salt.

5. The composition as in claim 1, wherein the at least one non-ionic surfactant comprises at least one member selected from the group consisting of fatty alcohol polyglycosides, linear alcohol ethoxylates, branched alcohol ethoxylates, alkyl phenol ethoxylates, and alcohol alkoxylates.

6. The composition as in claim 1, wherein the at least one non-ionic surfactant is an alcohol alkoxylate.

7. The composition as in claim 1, further comprising at least one additive.

8. The composition of claim 7, wherein the at least one additive comprises at least one member selected from the group consisting of a biocide, a buffer, a chelating agent, a colorant, a perfume, a preservative, a phosphate ester and a solvent.

9. The composition of claim 8, wherein the preservative comprises 1,2-benzisothiazolin-3-one sodium salt and 3-iodo-2-propynyl butyl carbamate.

10. The composition of claim 8, wherein the solvent comprises at least one member selected from the group consisting of water, polyethylene glycol, alcohol, ether and polyether.

11. The composition of claim 10, wherein the solvent is water.

12. A system for applying a lubricant to a conveyor belt, the system comprising:

a container with the lubricant composition as in claim 1; and a device to dispense the lubricant composition as in claim 1 from the container to the conveyor belt.

13. The system of claim 12, wherein the system is attached to the conveyor belt.

14. A method of lubricating a conveyor belt, the method comprising applying the lubricant composition as in claim 1 to the conveyor belt wherein recycled water with anions is in contact with the conveyor belt and wherein the lubricant composition has a coefficient of friction of less than 0.3 when lubricating the conveyor belt.

15. The method of claim 14, wherein the lubricant composition is continuously applied onto the conveyor belt.

16. The method as in claim 14, wherein the lubricant composition is applied to the conveyor belt during an application time and is not applied to the conveyor belt during a non-application time at a ratio of application time to non-application time between 1:0 to 1:100.

17. A method of lubricating a conveyor belt, the method comprising applying a lubricant composition to the conveyor belt wherein recycled water with anions is in contact with the conveyor belt, wherein the lubricant composition has a coefficient of friction of less than 0.3 when lubricating the conveyor belt and wherein the lubricant composition comprises:

65 wt % to 95 wt % water;

2 wt % to 5 wt % N-coco, 1,3-diaminopropane;

0.5 wt % to 10 wt % N-lauroyl sarcosinic acid sodium salt;

0.5 wt % to 5 wt % of at least one non-ionic surfactant;

0.5 wt % to 5 wt % of a buffer; and 0.5 wt % to 3 wt % of a phosphate ester.

18. A lubricant composition comprising:

65 wt % to 95 wt % water;

1 wt % to 25 wt % of at least one amphoteric surfactant;

2 wt % to 5 wt % N-coco, 1,3-diaminopropane;

1 wt % to 5 wt % of at least one buffer; and 0.2 wt % to 5 wt % of at least one additive.

19. A system for applying a lubricant to a conveyor belt, the system comprising:

a container with the lubricant composition as in claim 18; and a device to dispense the lubricant composition as in claim 18 from the container to the conveyor belt.

20. A method of lubricating a conveyor belt, the method comprising applying the lubricant composition as in claim 18 to the conveyor belt wherein recycled water with anions is in contact with the conveyor belt and wherein the lubricant composition has a coefficient of friction of less than 0.3 when lubricating the conveyor belt.

21. A lubricant composition comprising:

65 wt % to 95 wt % water;

0.5 wt % to 15 wt % of at least one cationic surfactant, wherein the at least one cationic surfactant is a diamine;

2 wt % to 5 wt % of at least one non-ionic surfactant, wherein the at least one non-ionic surfactant is alcohol (C13) ethoxylate (12EO);

1 wt % to 5 wt % of at least one buffer; and 0.2 wt % to 5 wt % of at least one additive.

22. A system for applying a lubricant to a conveyor belt, the system comprising:

a container with the lubricant composition as in claim 21; and a device to dispense the lubricant composition as in claim 21 from the container to the conveyor belt.

23. A method of lubricating a conveyor belt, the method comprising applying the lubricant composition as in claim 21 to the conveyor belt wherein recycled water with anions is in contact with the conveyor belt and wherein the lubricant composition has a coefficient of friction of less than 0.3 when lubricating the conveyor belt.

24. The composition as in claim 1, wherein the at least one amphoteric surfactant is a combination of β-alanine, N-(2-carboxyethyl)N-tallow alkyl derivative and β-alanine, N-(2-carboxyethyl)N-(2-ethylhexyl) monosodium salt; the at least one anionic surfactant is an N-acyl-sarcosinate; and the at least one non-ionic surfactant is an alcohol alkoxylate.

25. The composition as in claim 1, wherein surfactant in the lubricant composition consists of the at least one amphoteric surfactant, the at least one anionic surfactant, and the at least one non-ionic surfactant.

26. The composition as in claim 1, wherein the lubricant composition consists of the water, the at least one amphoteric surfactant, the at least one anionic surfactant, the at least one non-ionic surfactant, and optionally, at least one preservative.

27. The composition as in claim 24, wherein the lubricant composition consists of the water, the β-alanine, N-(2-carboxyethyl)N-tallow alkyl derivative and β-alanine, N-(2-carboxyethyl)N-(2-ethylhexyl) monosodium salt, the N-acyl-sarcosinate, the alcohol alkoxylate, and optionally, one or more preservatives.

28. The composition as in claim 21, wherein the diamine is N-oleyl-1,3-propanediamine.

29. The composition as in claim 21, wherein the lubricant composition consists of the water, the at least one cationic surfactant, the at least one non-ionic surfactant, the at least one buffer, and the at least one additive.

30. The composition as in claim 29, wherein the lubricant composition consists of the water, N-oleyl-1,3-propanediamine, the alcohol (C13) ethoxylate (12EO), acetic acid, tributoxyethyl phosphate, and optionally, N,N-bis (3-aminopropyl) dodecylamine.

31. The composition as in claim 17, wherein the lubricant composition consists of the water, the N-coco, 1,3-diaminopropane, the N-lauroyl sarcosinic acid sodium salt, an alcohol alkoxylate, the buffer, and the phosphate ester.

32. The composition as in claim 31, wherein the lubricant composition consists of the water, the N-coco, 1,3-diaminopropane, the N-lauroyl sarcosinic acid sodium salt, the alcohol alkoxylate, acetic acid, and tributoxyethyl phosphate.

33. The composition as in claim 18, wherein the lubricant composition consists of the water, the at least one amphoteric surfactant, the N-coco, 1,3-diaminopropane, and the at least one additive.

34. The composition as in claim 33, wherein the lubricant composition consists of the water, the N-coco, 1,3-diaminopropane, cocamidopropyl betaine, alkyl (C8) amino dipropionate monosodium salt, acetic acid, and tributoxyethyl phosphate.

* * * * *